US009950538B2

(12) United States Patent
Sugahara et al.

(10) Patent No.: US 9,950,538 B2
(45) Date of Patent: Apr. 24, 2018

(54) LIQUID EJECTING HEAD AND LIQUID EJECTING DEVICE

(71) Applicant: Brother Kogyo Kabushiki Kaisha, Nagoya-shi, Aichi-ken (JP)

(72) Inventors: Hiroto Sugahara, Ama (JP); Shohei Koide, Nagoya (JP); Taisuke Mizuno, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/606,486

(22) Filed: May 26, 2017

(65) Prior Publication Data

US 2017/0259579 A1 Sep. 14, 2017

Related U.S. Application Data

(62) Division of application No. 15/086,432, filed on Mar. 31, 2016, now Pat. No. 9,688,076.

(30) Foreign Application Priority Data

Mar. 31, 2015 (JP) ..... 2015-072115

(51) Int. Cl.
*B41J 2/14* (2006.01)
*B41J 2/17* (2006.01)
(Continued)

(52) U.S. Cl.
CPC ..... *B41J 2/17563* (2013.01); *B41J 2/14233* (2013.01); *B41J 2/17509* (2013.01);
(Continued)

(58) Field of Classification Search
None
See application file for complete search history.

(56) References Cited

U.S. PATENT DOCUMENTS 6,343,857 B1 2/2002 Cowger
7,740,344 B2 6/2010 Takahashi et al.
(Continued)

FOREIGN PATENT DOCUMENTS

JP H03274165 A 12/1991
JP 03-30-2016H072515 A 10/1995
(Continued)

OTHER PUBLICATIONS

Oct. 12, 2016—U.S. Non-Final Office Action—U.S. Appl. No. 15/086,432.
(Continued)

*Primary Examiner* — Matthew Luu
*Assistant Examiner* — Tracey McMillion
(74) *Attorney, Agent, or Firm* — Banner & Witcoff, Ltd.

(57) ABSTRACT

A liquid ejecting head, including a flow-path unit that includes: first and second nozzle groups disposed alongside each other in a second direction orthogonal to a first direction in which nozzles are arranged; first and second common liquid chambers respectively communicating with the first and second nozzle groups, the first and second common liquid chambers being disposed alongside each other in the second direction; a liquid supply opening communicating with the first common liquid chamber and a liquid discharge opening communicating with the second common liquid chamber, on one side of the flow-path unit in the first direction; and a connecting path connecting the first and second common liquid chambers on the other side of the flow-path unit in the first direction, wherein the first common liquid chamber is disposed nearer to an outer periphery of the flow-path unit in the second direction than the second common liquid chamber.

15 Claims, 18 Drawing Sheets

(51) Int. Cl.
*B41J 2/175* (2006.01)
*B41J 2/18* (2006.01)

(52) U.S. Cl.
CPC ..... *B41J 2/18* (2013.01); *B41J 2002/14241* (2013.01); *B41J 2002/14459* (2013.01); *B41J 2202/12* (2013.01); *B41J 2202/20* (2013.01)

(56) References Cited

U.S. PATENT DOCUMENTS

| | | | | |
|---|---|---|---|---|
| 8,740,365 | B2 | 6/2014 | Uezawa et al. | |
| 9,233,535 | B2 | 1/2016 | Ito | |
| 2002/0180827 | A1 | 12/2002 | Hirota | |
| 2007/0091145 | A1 | 4/2007 | Takahashi et al. | |
| 2007/0103519 | A1* | 5/2007 | Takahashi | B41J 2/14209 347/85 |
| 2013/0082117 | A1 | 4/2013 | Ito | |
| 2013/0229473 | A1* | 9/2013 | Wells, Jr. | B41J 2/18 347/89 |
| 2014/0028748 | A1* | 1/2014 | Hudd | B41J 2/15 347/12 |

FOREIGN PATENT DOCUMENTS

| | | | |
|---|---|---|---|
| JP | 2757225 | B2 | 5/1998 |
| JP | H11-028823 | A | 2/1999 |
| JP | 2002-355961 | A | 12/2002 |
| JP | 3507169 | B2 | 3/2004 |
| JP | 2007-069126 | A | 3/2007 |
| JP | 2007-118311 | A | 5/2007 |
| JP | 2007-125763 | A | 5/2007 |
| JP | 2012-006224 | A | 1/2012 |
| JP | 2013-075404 | A | 4/2013 |
| JP | 2014-141102 | A | 8/2014 |

OTHER PUBLICATIONS

Mar. 31, 2017—U.S. Notice of Allowance—U.S. Appl. No. 15/086,432.

* cited by examiner

LIQUID EJECTING HEAD AND LIQUID EJECTING DEVICE

CROSS REFERENCE TO RELATED APPLICATION

This is a divisional of U.S. application Ser. No. 15/086,432, filed Mar. 31, 2016, which claims priority from Japanese Patent Application No. 2015-072115, filed on Mar. 31, 2015, the disclosures of which are hereby incorporated by reference in their entireties.

BACKGROUND

Technical Field

The disclosure relates to a liquid ejecting head and a liquid ejecting device.

Description of Related Art

A printer having a plurality of pint heads is known as a liquid ejecting device. The known printer uses ink in which a particle material such as spacer particles is dispersed in a solvent. Each print head is connected to an ink supply portion through a supply pipe and a discharge pipe. Ink supplied from the ink supply portion to each print head via the supply pipe is returned to the ink supply portion through the discharge pipe. That is, the ink is circulated between the ink supply portion and each print head.

Each print head includes a plurality of nozzles and a plurality of ink chambers which respectively communicate with the plurality of nozzles. The nozzles are arranged in one row, and the plurality of ink chambers are alternately disposed on the right side and the left side with respect to the nozzle row in a zigzag fashion, so as to form two rows. Each print head includes two main pipes for supplying the ink to the ink chambers arranged in the two rows and a connecting pipe that connects the two main pipes. The ink supplied from the ink supply portion to the print head flows from one of the two main pipes to the other main pipe via the connecting pipe and returns to the ink supply portion from the other main pipe.

SUMMARY

Some liquid ejecting devices use a liquid having a high viscosity. In an instance where the liquid is supplied to the head with its high viscosity maintained, the liquid is not likely to be ejected from the nozzles. To avoid this, the liquid is heated in advance and supplied to the head with its viscosity lowered.

When the heated liquid is supplied to the head, the temperature of the head increases as a whole due to the heated liquid. In this case, the outer periphery of the head is likely to get cold because of a large heat dissipation amount. In contrast, the temperature of the head is slowly decreased at its central portion because of a small heat dissipation amount. Thus, there may be a risk that temperature nonuniformity is caused in the head. The temperature nonuniformity may cause, among the nozzles, a variation in the temperature and the viscosity of the liquid to be ejected, causing a difference in ejection characteristics among the nozzles.

An aspect of the disclosure relates to a liquid ejecting head to which a liquid is supplied, wherein temperature nonuiformity is prevented or reduced, for instance, so that a difference in ejection characteristics among different nozzles is accordingly reduced.

In one aspect of the disclosure, a liquid ejecting head includes a flow-path unit that includes: a first nozzle group including a plurality of nozzles arranged in a first direction; a second nozzle group including a plurality of nozzles arranged in the first direction, the second nozzle group being disposed alongside the first nozzle group in a second direction orthogonal to the first direction; a first common liquid chamber extending in the first direction and communicating with the first nozzle group; a second common liquid chamber extending in the first direction and communicating with the second nozzle group, the second common liquid chamber being disposed alongside the first common liquid chamber in the second direction; a liquid supply opening communicating with one end of the first common liquid chamber in the first direction that is located on one of opposite sides of the flow-path unit in the first direction; a liquid discharge opening communicating with one end of the second common liquid chamber in the first direction that is located on the one of the opposite sides of the flow-path unit in the first direction; and a connecting path connecting another end of the first common liquid chamber in the first direction that is located on the other of the opposite sides of the flow-path unit in the first direction and another end of the second common liquid chamber in the first direction that is located on the other of the opposite sides of the flow-path unit in the first direction, wherein the first common liquid chamber is disposed nearer to an outer periphery of the flow-path unit in the second direction than the second common liquid chamber.

In another aspect of the disclosure, a liquid ejecting device includes: the liquid ejecting head described above; a reservoir connected to the liquid supply opening and the liquid discharge opening of the liquid ejecting head and storing a liquid; a liquid circulator configured to circulate the liquid between the reservoir and the liquid ejecting head, and a heater configured to heat the liquid to be supplied to the liquid ejecting head.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF EMBODIMENTS

First Embodiment

Figure 1:
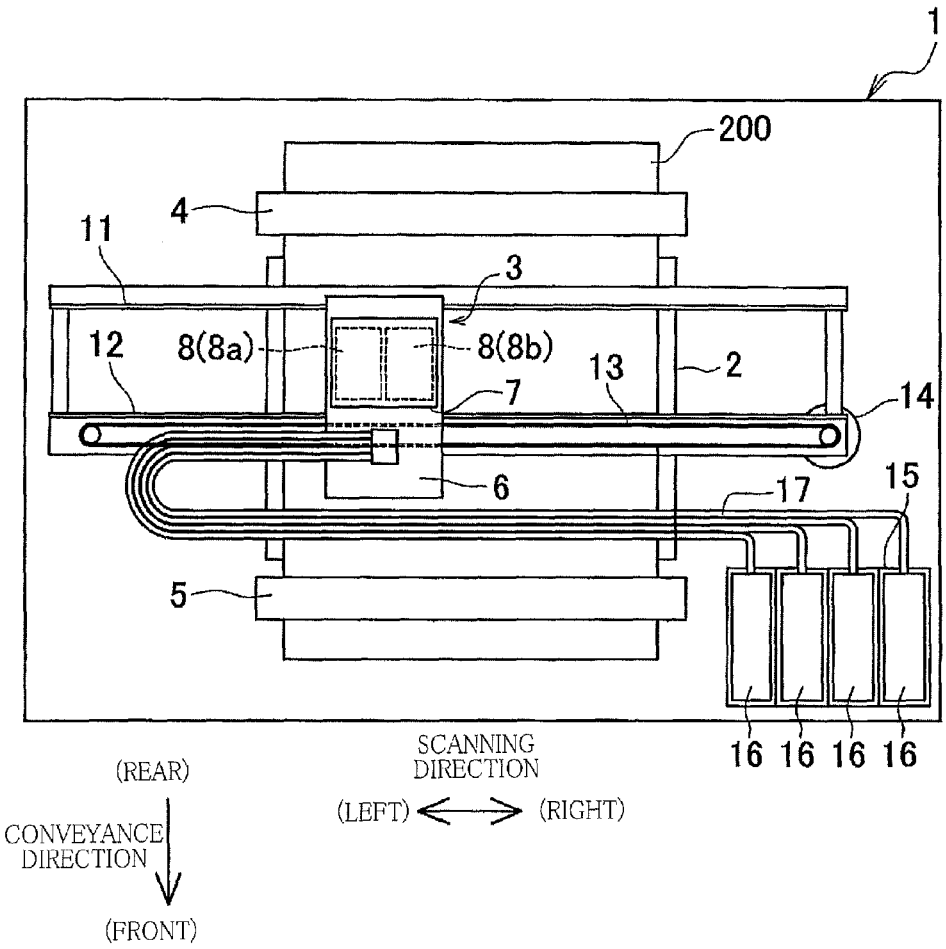
FIG. 1 is a plan view of an ink-jet printer according to a first embodiment.

There will be described a first embodiment. A scanning direction indicated in FIG. 1 is defined as a right-left direction of a printer 1. The right side in FIG. 1 is defined as a right side of the printer 1 while the left side in FIG. 1 is defined as a left side of the printer 1. An upstream side and a downstream side in a conveyance direction indicated in FIG. 1 are respectively defined as a rear side and a front side of the printer 1. Further, a direction orthogonal to the scanning direction and the conveyance direction, namely, a direction orthogonal to the sheet plane of FIG. 1, is defined as an up-down direction of the printer 1. One of opposite sides of the sheet of FIG. 1 corresponding to the front surface of the sheet is defined as an upper side of the printer 1 while the other side corresponding to the back surface of the sheet is defined as a lower side of the printer 1. The following description is based on these definitions.

Structure of Printer

Figure 2:
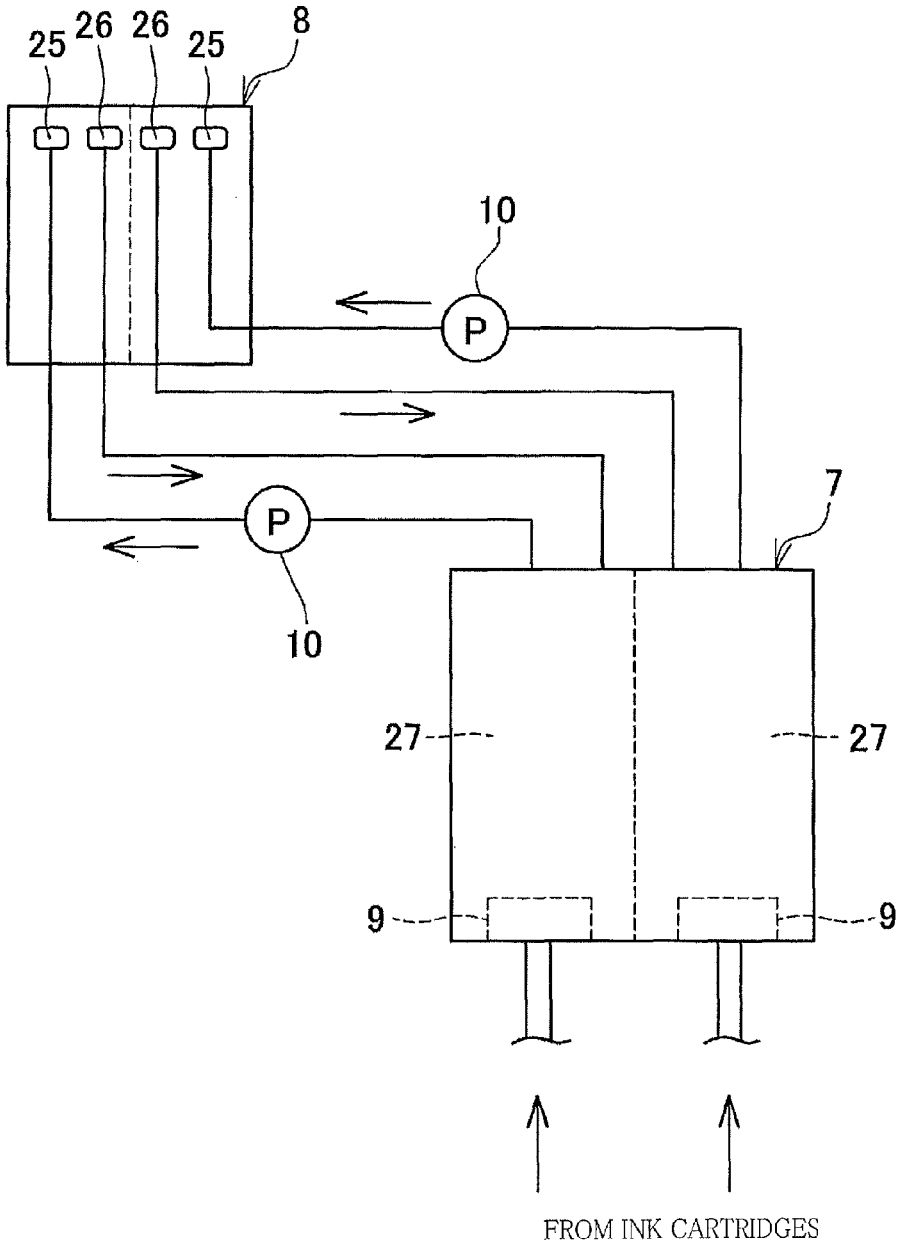
FIG. 2 is a view schematically showing a connection between a sub tank and an ink-jet head.

As shown in FIGS. 1 and 2, the ink-jet printer 1 includes a platen 2, an ink ejecting device 3, and conveying rollers 4, 5.

A recording sheet 200 as one example of a recording medium is placed on an upper surface of the platen 2. The ink ejecting device 3 is configured to eject ink toward the recording sheet 200 placed on the platen 2 so as to record an image thereon. The ink ejecting device 3 includes a carriage 6, a sub tank 7, two ink-jet heads 8 (8*a*, 8*b*), heaters 9, circulating pumps 10.

The carriage 6 is movable in a region in which the carriage 6 is opposed to the platen 2, so as to reciprocate in the scanning direction along two guide rails 11, 12. An endless belt 13 is connected to the carriage 6. When the endless belt 13 is driven by a carriage drive motor 14, the carriage 6 reciprocates in the scanning direction.

The sub tank 7 and the two ink-jet heads 8 are mounted on the carriage 6 and are reciprocatingly movable with the carriage 6 in the scanning direction. The sub tank 7 is connected, through tubes 17, to a cartridge holder 15 that holds four ink cartridges 16 in which black ink, yellow ink, cyan ink, and magenta ink are respectively stored. Four ink chambers 27 are formed in the sub tank 7. The black ink, the yellow ink, the cyan ink, and the magenta ink 4 supplied from the respective four ink cartridges 16 are stored in the respective four ink chambers 27. In FIG. 2, only two ink chambers 27 corresponding to the ink in two colors of one ink-jet head 8 are illustrated for the sake of brevity.

The two ink-jet heads 8 (8*a*, 8*b*) are disposed right under the sub tank 7 so as to be arranged alongside each other in the scanning direction. Each ink-jet head 8 has a plurality of nozzles 20 (FIGS. 3-5) formed in its lower surface (that corresponds to the back surface of the sheet of FIG. 1. Each of the two ink-jet heads 8 ejects ink in two of the four colors (black, yellow, cyan, magenta) stored in the sub tank 7. Specifically, the left-side ink-jet head 8*a* ejects the black ink and the yellow ink, and the right-side ink-jet head 8*b* ejects the cyan ink and the magenta ink.

As shown in FIG. 2, two ink supply openings 25 and two ink discharge openings 26 corresponding to the ink in the respective two colors are formed on an upper surface of each ink-jet head 8. A set of the ink supply opening 25 and the ink discharge opening 26 for one color is connected to one ink chamber 27 of the sub tank 7 via tubes.

The ink used in the printer 1 of the present embodiment has a considerably high viscosity at room temperature. For instance, the viscosity of the ink at 25° C. is 12 cp. It is thus difficult to eject the ink from the nozzles 20 of the ink-jet head 8 at room temperature. In order to lower the viscosity of the ink to be supplied to the ink-jet head 8, the present embodiment employs a configuration in which the ink is heated in the sub tank 7 to about 40° C., and the heated ink is circulated between the ink-jet head 8 and the sub tank 7. The viscosity of the ink at 40° C. is 6.2 cp, for instance.

The heater 9 is provided in each ink chamber 27 of the sub tank 7. The heater 9 is configured to heat the ink in the ink chamber 27 to 40° C., for instance. Further, a circulating pump 10 is provided between each ink chamber 27 of the sub tank 7 and the corresponding ink supply opening 25 of the ink-jet head 8. For instance, the circulating pump 10 is a tube pump configured to press out a liquid in a tube by squeezing the tube by a rotor. The circulating pump 10 feeds the ink in the ink chamber 27 into the ink-jet head 8, thereby circulating the link between the ink chamber 27 of the sub tank 7 and the ink-jet head 8. The device for circulating the ink is not limited to the circulating pump 10. For instance, there may be employed a device for pressurizing the ink by feeding pressurized air into the sub tank 7.

The two ink-jet heads 8*a*, 8*b* eject the ink in the respective four colors supplied from the sub tank 7 toward the recording sheet 200 placed on the platen 2 while moving in the scanning direction with the carriage 6.

As shown in FIG. 1, the conveying roller 4 is disposed on the upstream side (the rear side) of the platen 2 in the conveyance direction while the conveying roller 5 is disposed on the downstream side (the front side) of the platen 2 in the conveyance direction. The two conveying rollers 4, 5 are driven by a motor (not shown) in synchronism with each other. The two conveying rollers 4, 5 convey the recording sheet 200 placed on the platen 2 in the conveyance direction orthogonal to the scanning direction.

Detailed Structure of Ink-Jet Head

Figure 3:
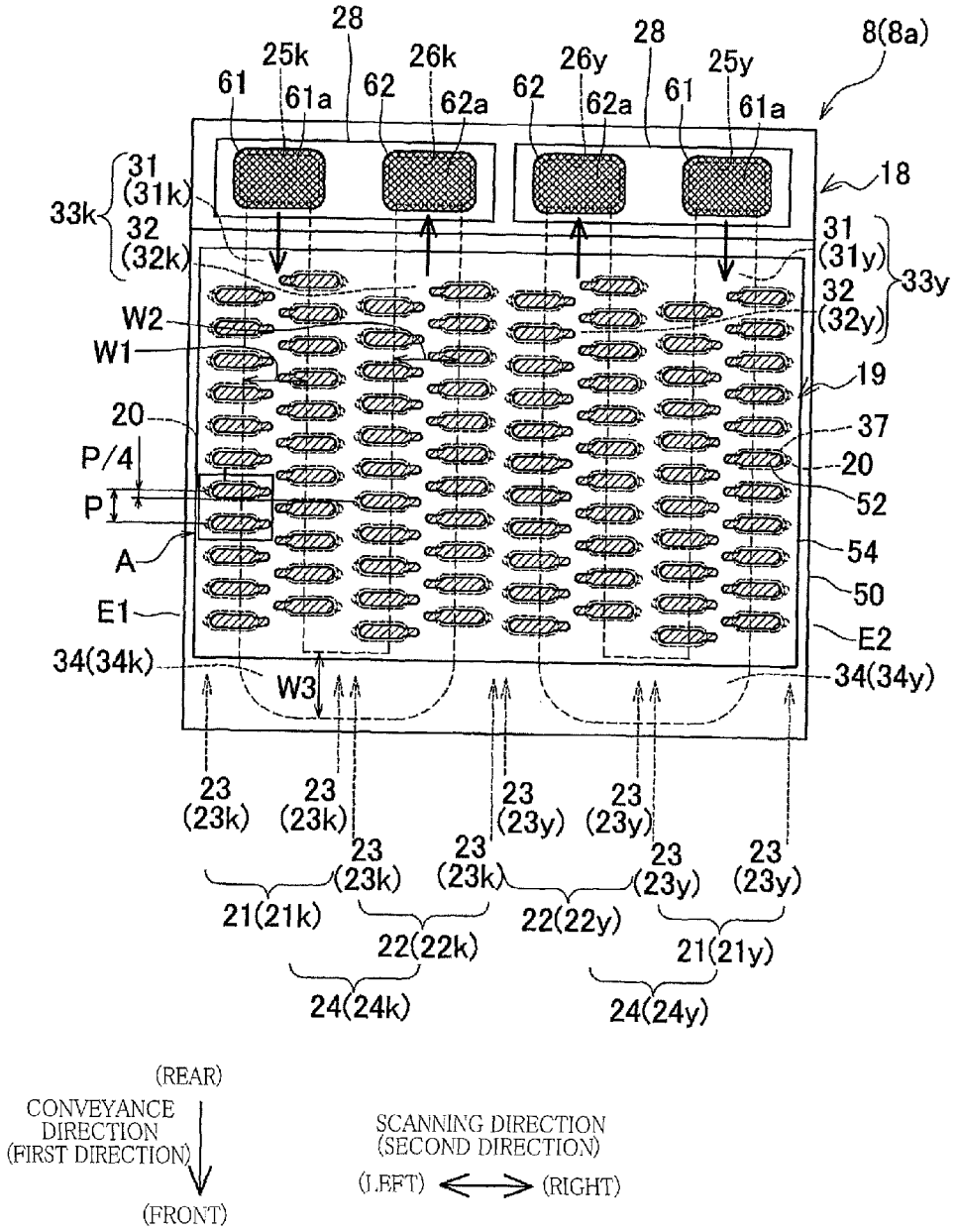
FIG. 3 is a plan view of one ink-jet head (8)
Figure 4:
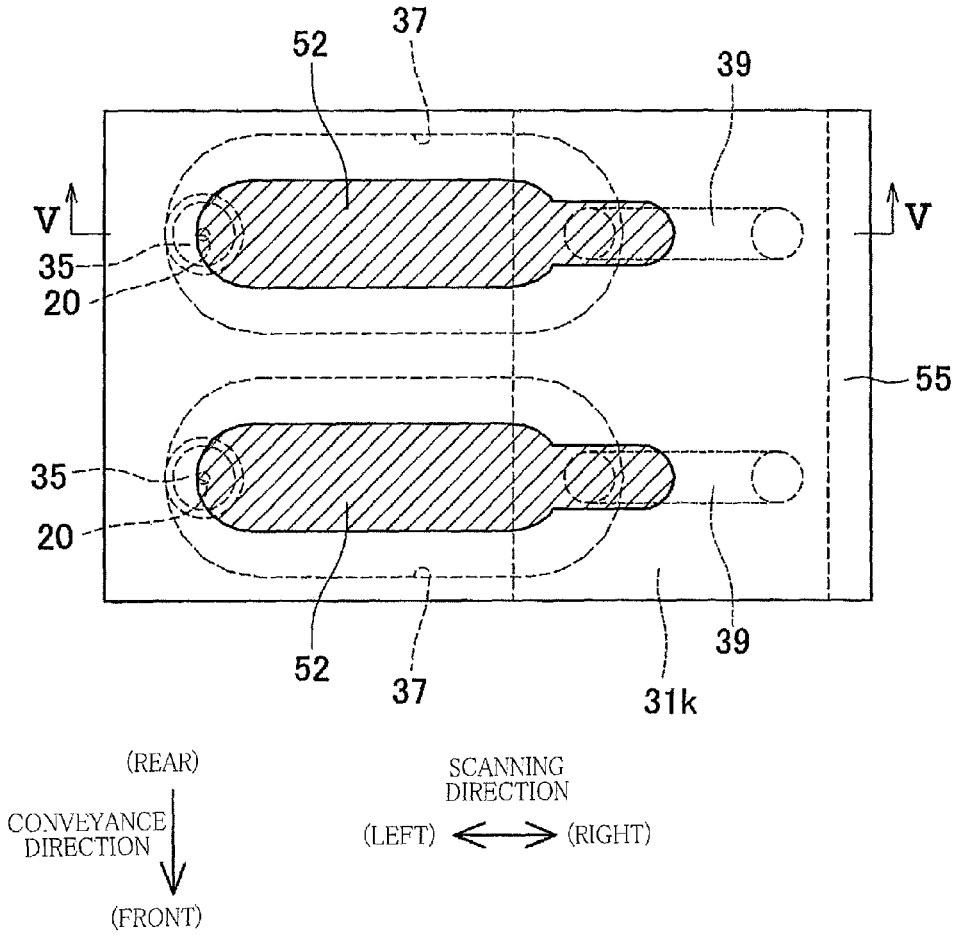
FIG. 4 is an enlarged view of a portion A in FIG. 3.
Figure 5:
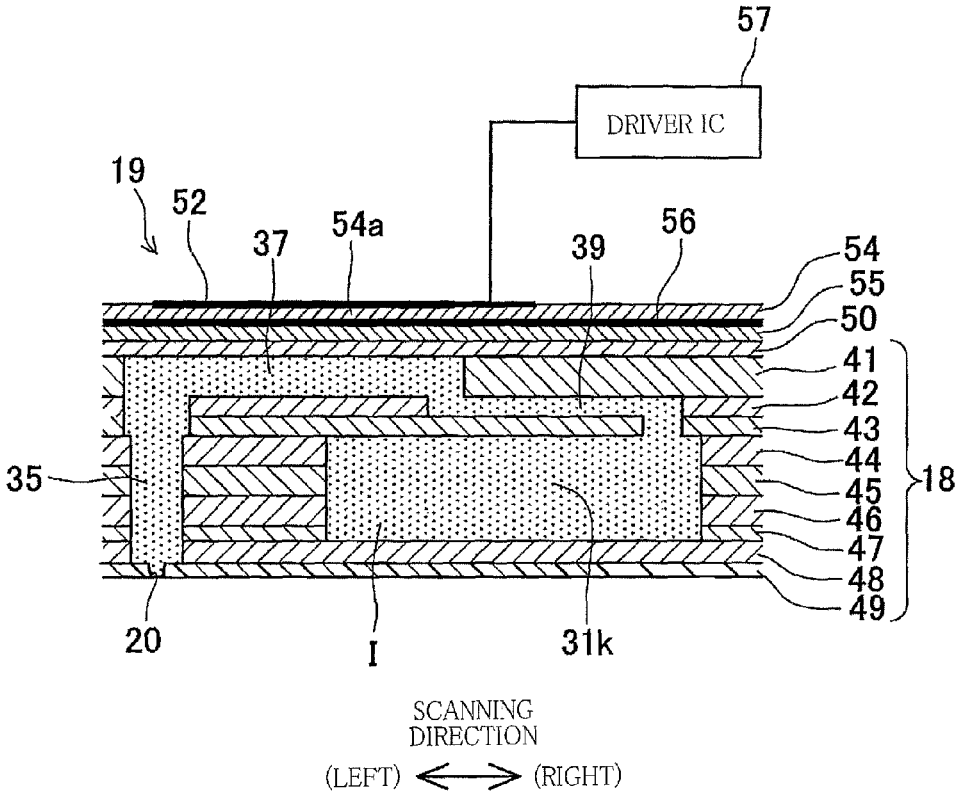
FIG. 5 is a cross sectional view taken along line V-V in FIG. 4.

The ink-jet head 8 will be described in detail. Because the two ink-jet heads 8 are identical to each other in structure, the left-side ink-jet head 8*a* configured to eject the black ink and the yellow ink will be described. As shown in FIGS. 3-5, the ink-jet head 8 includes a flow-path unit 18 and a piezoelectric actuator 19. FIG. 5 shows a state in which ink paths formed in the flow-path unit 18 are filled with the ink (indicated by "I").

Flow-Path Unit

As shown in FIG. 5, the flow-path unit 18 has a stacked structure in which a plurality of plates 41-49 are stacked on one another. The stacked plates 41-49 are bonded to one another by an adhesive. The lowermost one of the plates 41-49 is a nozzle plate 49 formed of synthetic resin such as polyimide. The nozzles 20 are formed in the nozzle plate 49.

As shown in FIG. 3, the nozzles 20 are arranged in the conveyance direction so as to form eight nozzle rows 23 arranged in the scanning direction. Left-side four nozzle rows 23 eject the black ink, and right-side four nozzle rows 23 eject the yellow ink. In the following explanation, a sign "k" is attached to a reference numeral of each of structures relating to the black ink, and a sign "y" is attached to a reference numeral of each of structures relating to the yellow ink. For instance, the nozzle row 23*y* refers to a nozzle row 23 that ejects the yellow ink. In an instance where a pitch at which the nozzles 20 of each nozzle row 23 is represented as P, the nozzles 20 of each nozzle row 23 is shifted in the conveyance direction by a distance P/4 with respect to the nozzles 20 of the other nozzle rows 23.

As explained later, one manifold 31 (32) is disposed between adjacent two nozzle rows 23, and the nozzles 20 in the adjacent two nozzle rows 23 communicate with the one manifold 31 (32). In the following explanation, a group of the nozzles 20 (i.e., two nozzle rows 23) communicating with one manifold 31 (32) will be referred to as a nozzle group 21 (22), for the sake of convenience. In the ink-jet head 8*a*, the left-side (outside) two nozzle rows 23*k* for the black ink constitute a first nozzle group 21*k*, and the right-side (inside) two nozzle rows 23*k* for the black ink constitute a second nozzle group 22*k*. Further, the right-side (outside) two nozzle rows 23*y* for the yellow ink constitute a first nozzle group 21*y*, and the left-side (inside) two nozzle rows 23*y* for the yellow ink constitute a second nozzle group 22*y*. In the present embodiment, a nozzle-group set 24*k* constituted by the first nozzle group 21*k* and the second nozzle group 22*k* for the black ink and a nozzle-group set 24*y* constituted by the first nozzle group 21*y* and the second nozzle group 22*y* for the yellow ink are disposed alongside each other in the scanning direction.

The plates 41-48 of the flow-path unit 18 other than the nozzle plate 49 are formed of a metal material such as stainless steel. In the plates 41-48, there are formed ink passages, such as the manifolds 31 (32) and pressure chambers 37, which communicate with the nozzles 20.

As shown in FIG. 3, at a rear end portion of the uppermost plate 41 that constitutes an upper surface of the flow-path unit 18, an ink supply opening 25*k* for the black ink, an ink discharge opening 26*k* for the black ink, and an ink discharge opening 26*y* for the yellow ink, and an ink supply opening 25*y* for the yellow ink are formed so as to be arranged in this order from the left in the scanning direction. The black-ink supply opening 25*k* and the black-ink discharge opening 26*k* are connected to the ink chamber 27 (FIG. 2) for the black ink of the sub tank 7. The yellow-ink supply opening 25*y* and the yellow-ink discharge opening 26*y* are connected to the ink chamber 27 (FIG. 2) for the yellow ink of the sub tank 7. In the present embodiment, an opening area of each ink supply opening 25*k*, 25*y* and an opening area of each ink discharge opening 26*k*, 26*y* are the same. For instance, the opening area is 20 $mm^2$.

Two filter members 28 are bonded to an upper surface of the rear end portion of the plate 41. One of the two filter members 28 commonly covers the black-ink supply opening 25*k* and the black-ink discharge opening 26*k*. The other of the two filter members 28 commonly covers the yellow-ink supply opening 25*y* and the yellow-ink discharge opening 26*y*. Each filter member 28 includes a first filter 61 in which a plurality of first pores 61*a* are formed and which covers the ink supply opening 25 and a second filter 62 in which a plurality of second pores 62*a* are formed and which covers the ink discharge opening 26. While the material and the production method of the filter members 28 are not limited, a nickel filter formed by electroforming is preferably used, for instance.

Four manifolds 31 (32) each extending in the conveyance direction are formed in the fourth through seventh plates 44-47 from the top. The four manifolds 31 (32) are connected, at rear ends thereof, respectively to the ink supply opening 25*k*, the ink discharge opening 26*k*, the ink discharge opening 26*y*, and the ink supply opening 25*y* which are formed in the plate 41, via corresponding communication holes (not shown) formed in the plates 42, 43.

One of the two manifolds 31*k*, 32*k* for the black ink that communicates with the ink supply opening 25*k* is referred to as a first manifold 31*k* while the other of the two manifolds 31*k*, 32*k* that communicates with the ink discharge opening 26*k* is referred to as a second manifold 32*k*. Similarly, one of the two manifolds 31*y*, 32*y* for the yellow ink that communicates with the ink supply opening 25*y* is referred to as a first manifold 31*y* while the other of the two manifolds 31*y*, 32*y* that communicates with the ink discharge opening 26*y* is referred to as a second manifold 32*y*. In the present embodiment, a manifold set 33*k* constituted by the first manifold 31*k* and the second manifold 32*k* for the black ink and a manifold set 33*y* constituted by the first manifold 31*y* and the second manifold 32*y* for the yellow ink are disposed alongside each other in the scanning direction.

At portions of the respective fourth through seventh plates 44-47 located frontward of the four manifolds 31 (32), two connecting paths 34 each extending in the scanning direction are formed. A connecting path 34*k* connects front end portions of the first manifold 31*k* and the second manifold 32*k* for the black ink. A connecting path 34*y* connects front end portions of the first manifold 31*y* and the second manifold 32*y* for the yellow ink. In other words, there are formed, in the flow-path unit 18, two flow paths for the respective black ink and yellow ink each of which has a U-shape in plan view and extends from the ink supply opening 25 to the ink discharge opening 26 via the first manifold 31, the connecting path 34, and the second manifold 32. In the present embodiment, a width W1 of the first manifold 31 in the scanning direction is equal to a width W2 of the second manifold 32 in the scanning direction. Further, the widths W1, W2 are equal to a width W3 of the connecting path 34 in the conveyance direction.

The ink heated in the ink chamber 27 of the sub tank 7 is supplied to the ink supply opening 25 of the ink-jet head 8 and flows into the first manifold 31. The ink subsequently flows into the second manifold 32 via the connecting path 34 and thereafter returns to the ink chamber 27 of the sub tank 7 through the ink discharge opening 26.

The first manifold 31*k* that communicates with the black-ink supply opening 25*k* is located more outside than the second manifold 32*k* in the scanning direction, namely, the first manifold 31*k* is located near to a left-side edge E1 of the outer periphery of the flow-path unit 18. The first manifold 31*y* that communicates with the yellow-ink supply opening 25*y* is located more outside than the second manifold 32*y* in the scanning direction, namely, the first manifold 31*y* is located near to a right-side edge E2 of the outer periphery of the flow-path unit 18.

In the uppermost plate 41 of the flow-path unit 18, a plurality of pressure chambers 37 are formed so as to correspond to the respective nozzles 20. Each pressure chamber 37 has a generally oval shape, in plan view, which is long in the scanning direction. The pressure chambers 37 are formed in eight rows corresponding to the eight rows of the nozzles 20. Two rows of the pressure chambers 37 corresponding to the two nozzle rows 23 of one nozzle group 21 are respectively disposed on opposite sides of one manifold 31 (32). The pressure chambers 37 are covered with an oscillating plate 50 of the piezoelectric actuator 19. As shown in FIGS. 3 and 4, a plurality of orifice paths 39, each of which connects the manifold 31 (32) and a corresponding one of the pressure chambers 37, are formed through the second plate 42 from the top. Further, communication paths 35, each of which connects a corresponding one of the pressure chambers 37 and a corresponding one of the nozzles 20, are formed through the seven plates 42-48 located between the uppermost plate 41 and the nozzle plate 49.

In the thus formed flow-path unit 18, there are formed a plurality of individual paths each of which extends from the manifold 31 (32) and reaches the nozzle 20 via the orifice path 39, the pressure chamber 37, and the communication path 35. In other words, one nozzle group 21 (22) constituted by two nozzle rows 23 communicates with one manifold 31 (32) via the pressure chambers 37 formed on the opposite sides of the one manifold 31 (32). That is, the first nozzle group 21*k* for the black ink communicates with the first manifold 31*k* for the black ink, and the second nozzle group 22*k* for the black ink communicates with the second manifold 32*k* for the black ink. Similarly, the first nozzle group 21*y* for the yellow ink communicates with the first manifold 31*y* for the yellow ink, and the second nozzle group 22*y* for the yellow ink communicates with the second manifold 32*y* for the yellow ink.

Piezoelectric Actuator

The piezoelectric actuator 19 is provided on the upper surface of the flow-path unit 18. As shown in FIGS. 3-5, the piezoelectric actuator 19 includes the oscillating plate 50, piezoelectric layers 54, 55, a plurality of individual electrodes 52, and a common electrode 56. The two piezoelectric layers 54, 55 are stacked on an upper surface of the oscillating plate 50 disposed on the flow-path unit 18. The individual electrodes 52 are provided on an upper surface of the upper piezoelectric layer 54 so as to be opposed to the respective pressure chambers 37. The common electrode 56 is provided between the two piezoelectric layers 54, 55 so as to be located across the plurality of pressure chambers 37.

The individual electrodes 52 are connected to a driver IC 57 through respective wirings (not shown). The common electrode 56 is always kept at a ground potential. Portions of the upper piezoelectric layer 54 sandwiched between the individual electrodes 52 and the common electrode 56 (each referred to as an active portion 54*a*) are polarized in the thickness direction thereof. The driver IC 57 applies drive signals to the individual electrodes 52*a* corresponding to the respective pressure chambers 37. Thus, the potential of each individual electrode 52 is switched between a predetermined drive potential and the ground potential.

When the drive signals are supplied from the driver IC 57 to the individual electrodes 52 and the potential of each individual electrode 52 accordingly changes to the drive potential, there is generated a potential difference between the individual electrodes 52 and the common electrode 56. In this instance, an electric field parallel to the thickness direction of the active portions 54*a* of the piezoelectric layer 54 acts on the active portions 54*a* due to the potential difference between the individual electrodes 52 and the common electrode 56. Because the polarization direction of the active portions 54*a* and the direction of the electric field coincide with each other, the active portions 54*a* expand in the thickness direction that coincides with the polarization direction and contract in the plane direction. The contraction of the active portions 54*a* causes the oscillating plate 50 to be bent or deformed so as to protrude toward the pressure chambers 37. Consequently, the volume of the pressure chambers 37 is decreased and the energy is given to the ink in the pressure chambers 37, so that ink droplets are ejected from the nozzles 20 communicating with the corresponding pressure chambers 37.

In the first embodiment, the ink heated by the heater 9 in the sub tank 7 is supplied to the flow-path unit 18 of the ink-jet head 8. In this instance, the temperature of the flow-path unit 18 is increased as a whole due to the heated ink. However, the outer periphery of the flow-path unit 18 is likely to get cold due to a large heat dissipation amount, as compared with the central portion of the flow-path unit 18, so that temperature nonuniformity is caused in flow-path unit 18. Due to the temperature nonuniformity, the temperature and the viscosity of the ink differ among the nozzles 20. That is, the temperature of the ink is low and the viscosity of the ink is accordingly high in the nozzles 20 located near to the outer periphery of the flow path unit 18, specifically, near to outer peripheral edges E1, E2 of the flow-path unit 18. In contrast, the temperature of the ink is high and the viscosity of the ink is accordingly low in the nozzles 20 located at the inside portion of the flow-path unit 18. Because the ink becomes hard to be ejected from the nozzles 20 with an increase in the viscosity of the ink, the ejection amount is decreased.

In the first embodiment, the first manifold 31 communicating with the ink supply opening 25 is disposed near to the outer periphery of the flow-path unit 18, i.e., nearer to the outer peripheral edge E1 (E2), than the second manifold 32. In other words, the first manifold 31, to which the ink having a high temperature is supplied from the ink supply opening 25, is disposed near to the outer peripheral edge E1 (E2) of the flow-path unit 18 at which the temperature tends to be quickly decreased. Thus, the temperature is prevented from being decreased at the outer periphery of the flow-path unit 18. The second manifold 32 is disposed at the inside portion of the flow-path unit 18 at which the temperature is slowly decreased, and the ink whose temperature has been decreased during passage through the first manifold 31 flows through the second manifold 32. Thus, the ink having a high temperature flows at the outer periphery of the flow path unit 18 at which the temperature is quickly decreased while the ink having a low temperature flows at the inside portion of the flow path unit 18 at which the temperature is slowly decreased. Consequently, the temperature nonuniformity in the flow-path unit 18 is prevented or reduced, so as to eliminate or reduce a difference in the ejection characteristics among the plurality of nozzles 20.

In each of the two manifold sets 33*k*, 33*y*, the manifold 31 communicating with the ink supply opening 25 is disposed more outside than the manifold 32 communicating with the ink discharge opening 26. That is, the two first manifolds 31*k*, 31*y* are disposed near to the respective outer peripheral edges E1, E2 of the flow-path unit 18 in the scanning direction, so that the temperature of the flow-path unit 18 is prevented from being decreased at the two outer peripheral edges E1, E2 of the flow-path unit 18 in the scanning direction.

The temperature of the ink is decreased in a time period in which the ink supplied into the flow-path unit 18 from the ink supply opening 25 flows in the flow-path unit 18 and is discharged from the ink discharge opening 26. As a result, a temperature difference, e.g., about 2-3° C., is generated between a portion of the first manifold 31 near to the ink supply opening 25 and a portion of the second manifold 32 near to the ink discharge opening 26. The temperature difference causes a difference in the ejection amount between the nozzles 20 located at the rear end of the first nozzle group 21 and the nozzles 20 located at the rear end of the second nozzle group 22. However, the difference in the ejection amount does not give a serious influence on printing of images on the recording sheet 200 for the following reasons.

Figure 6:
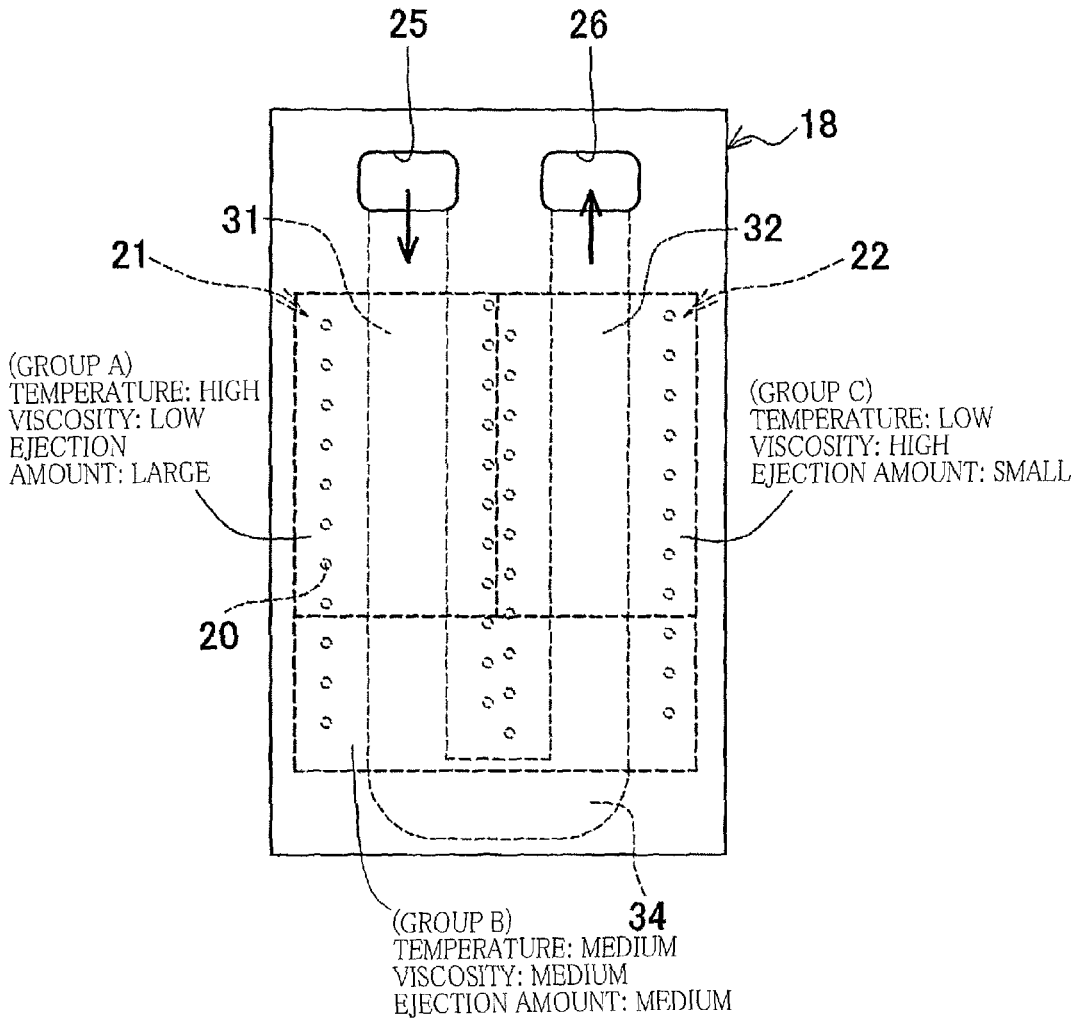
FIG. 6 is a view for explaining a difference in an ejection amount due to a difference in a temperature of ink between a vicinity of an ink supply opening and a vicinity of an ink discharge opening.

As shown in FIG. 6, for the sake of convenience, the nozzles 20 from which the ink in one color is ejected are divided into: a group A in which the nozzles 20 communicate with a rear portion of the first manifold 31; a group B in which the nozzles 20 communicate with a front portion of the first manifold 31 and a front portion of the second manifold 32; and a group C in which the nozzles 20 communicate with a rear portion of the second manifold 32. For the sake of brevity, only two nozzle groups 21, 22 for one color (e.g., black) are illustrated in FIG. 6.

In the nozzles 20 of the group A near to the ink supply opening 25, the temperature of the ink is high and the viscosity of the ink is low. In the nozzles 20 of the group B, the temperature of the ink is lower than and the viscosity of the ink is slightly higher than those in the nozzles 20 of the group A. In the nozzles 20 of the group C near to the ink discharge opening 26, the temperature of the ink is much lower than and the viscosity of the ink is much higher than those in the nozzles 20 of the group B. Because the ink is ejected in a larger amount with a decrease in the viscosity of the ink, the size of ink droplets to be ejected from the nozzles 20 is the largest in the group A, medium in the group B, and the smallest in the group C.

When the ink is ejected from the nozzles 20 while the carriage 6 is moved in the scanning direction, the ink ejected from the nozzles 20 of the group A and the ink ejected from the nozzles 20 of the group C are attached to the same region of the recording sheet 200 so as to form a part of an image. Thus, even though large ink droplets are ejected from the nozzles 20 of the group A and small ink droplets are ejected from the nozzles 20 of the group C, the difference in the droplet amount therebetween is offset. As a result, a difference in the density of the image is low between the part of the image formed by the nozzles 20 of the groups A and C and another part of the image formed by the nozzles 20 of the group B.

In the flow-path unit 18, foreign substances such as dust contained in the ink supplied from the sub tank 7 may enter the first manifold 31 through the ink supply opening 25. In view of this, the first filter 61 is provided for the ink supply opening 25 of the flow-path unit 18, so that the foreign substances are prevented from entering the first manifold 31 through the ink supply opening 25. Further, the second filter 62 is provided for the ink discharge opening 26. The ink discharge opening 26 is for permitting the ink to flow therethrough when the ink is discharged from the flow-path unit 18 to the sub tank 7. Thus, the foreign substances are unlikely to flow into the second manifold 32 through the ink discharge opening 26. However, when the ink ejection amount from the second nozzle group 22 is large and the ink pressure in the second manifold 32 is accordingly lowered to a high degree, there may be a risk that the ink flows back to the second manifold 32 from the sub tank 7. In such a case, the second filter 62 prevents the foreign substances from entering the second manifold 32 through the ink discharge opening 26.

In the manufacturing process of the ink-jet head 8, after both of the ink supply opening 25 and the ink discharge opening 26 are covered with the filter member 28 bonded to the flow-path unit 18, the foreign substances such as dust are unlikely to enter the flow-path unit 18. Consequently, working steps to be performed after the bonding of the filter member 28 can be carried out outside a clean room.

The ink flows into the ink supply opening 25 always from the upstream side, and therefore the foreign substances tend to flow into the flow-path unit 18 with the ink at a relatively high frequency. In contrast, there is little likelihood of the back flow of the ink from the ink discharge opening 26, and therefore the foreign substances are unlikely to flow into the flow-path unit 18 with the ink through the ink discharge opening 26. In view of this, the first pores 61*a* of the first filter 61 may have a smaller size than the second pores 62*a* of the second filter 62. For instance, the first pores 61*a* of the first filter 61 may have a diameter of 8 μm, and the second pores 62*a* of the second filter 62 may have a diameter of 12 μm. Thus, the first filter 61 can reliably catch the foreign substances in various sizes that flow into the flow-path unit 18 through the ink supply opening 25. Further, the second filter 62 which does not need to catch the foreign substances so frequently is formed to have larger-sized second pores 62*a*, thereby enabling a resistance to the flow of the ink to be kept small.

Though the first filter 61 and the second filter 62 may be separately formed by respective separate members, one filter member 28 has the first filter 61 and the second filter 62, so that the first filter 61 and the second filter 62 are formed integrally with each other in the present embodiment. Consequently, the first filter 61 and the second filter 62 can be mounted on the flow-path unit 18 simply by bonding the one filter member 28 to the rear end portion of the flow-path unit 18, simplifying mounting of the filters. As a result, the manufacturing cost can be reduced.

In the first embodiment described above, the ink ejecting device 3 is one example of "liquid ejecting device". The ink-jet head 8 is one example of "liquid ejecting head". The sub tank 7 is one example of "reservoir". The circulating pump 10 is one example of "liquid circulator". The conveyance direction is one example of "first direction" while the scanning direction is one example of "second direction". The ink supply opening 25 is one example of "liquid supply opening" while the ink discharge opening 26 is one example of "liquid discharge opening". The first manifold 31 is one example of "first common liquid chamber" while the second manifold 32 is one example of "second common liquid chamber". Each of the manifold sets 33*k*, 33*y* is one example of "set of common liquid chambers".

There will be next explained modifications of the first embodiment. In the following explanation, the same reference numerals as used in the first embodiment are used to identify the corresponding components and an explanation thereof is dispensed with.

Figure 7:
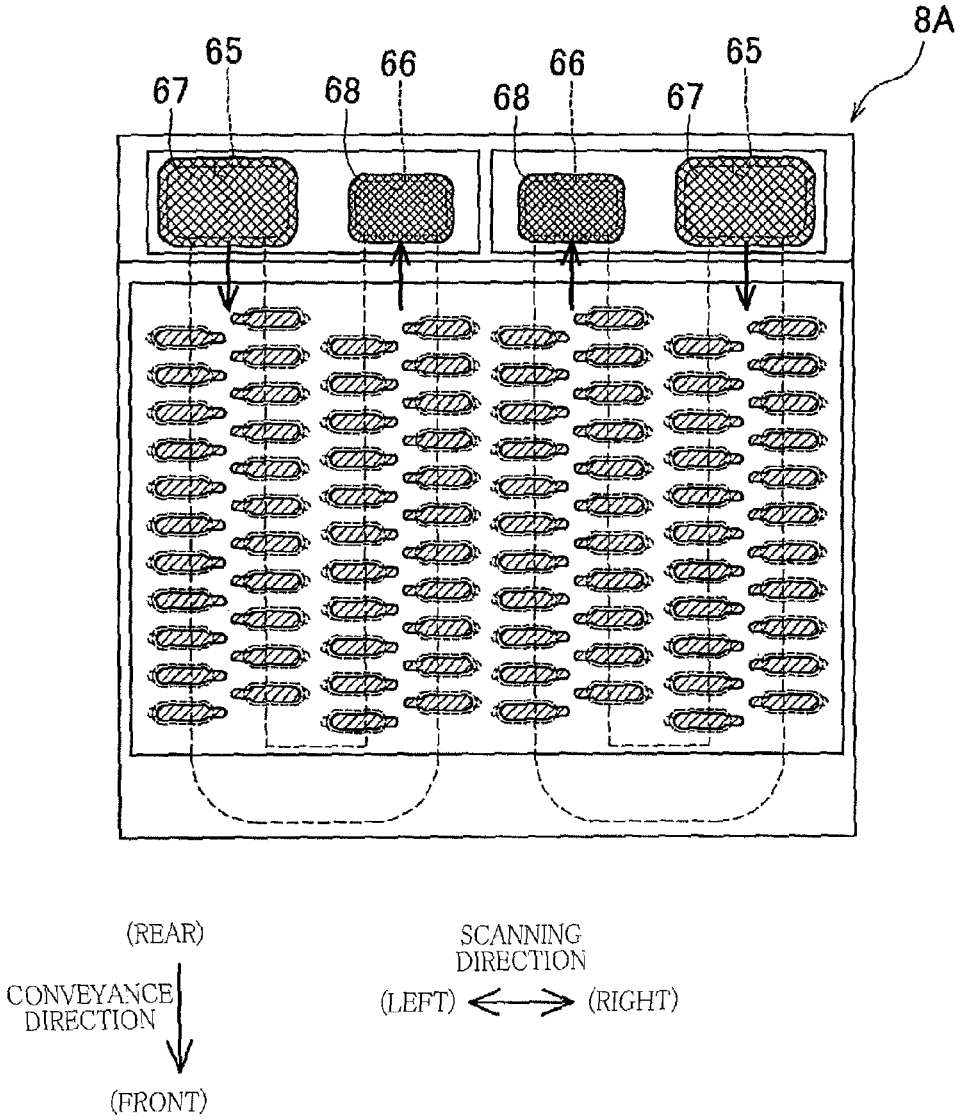
FIG. 7 is a plan view of an ink-jet head (8A) according to one modification of the first embodiment.

<1> As explained above with respect to the first embodiment, the foreign substances tend to flow into the flow-path unit 18 more frequently through the ink supply opening 25 than through the ink discharge opening 26. Consequently, the first filter 61 tends to be clogged at earlier timing than the second filter 62. In view of this, in an ink-jet head 8A shown in FIG. 7, an ink supply opening 65 has a larger opening area than an ink supply opening 66. For instance, the opening area of the ink supply opening 65 is 40 $mm^2$, and the opening area of the ink supply opening 66 is 20 $mm^2$. That is, the area of a portion of a first filter 67 covering the ink supply opening 65 is larger than the area of a portion of a second filter 68 covering the ink supply opening 66. In this configuration, the first filter 67 can catch a larger amount of the foreign substances than the second filter 68, so as to increase a time before the first filter 67 becomes clogged.

<2> In the first embodiment, one first manifold 31 and one second manifold 32 are provided for the ink in one color. A plurality of first manifolds and a plurality of second manifolds may be provided for the ink in one color.

Figure 8:
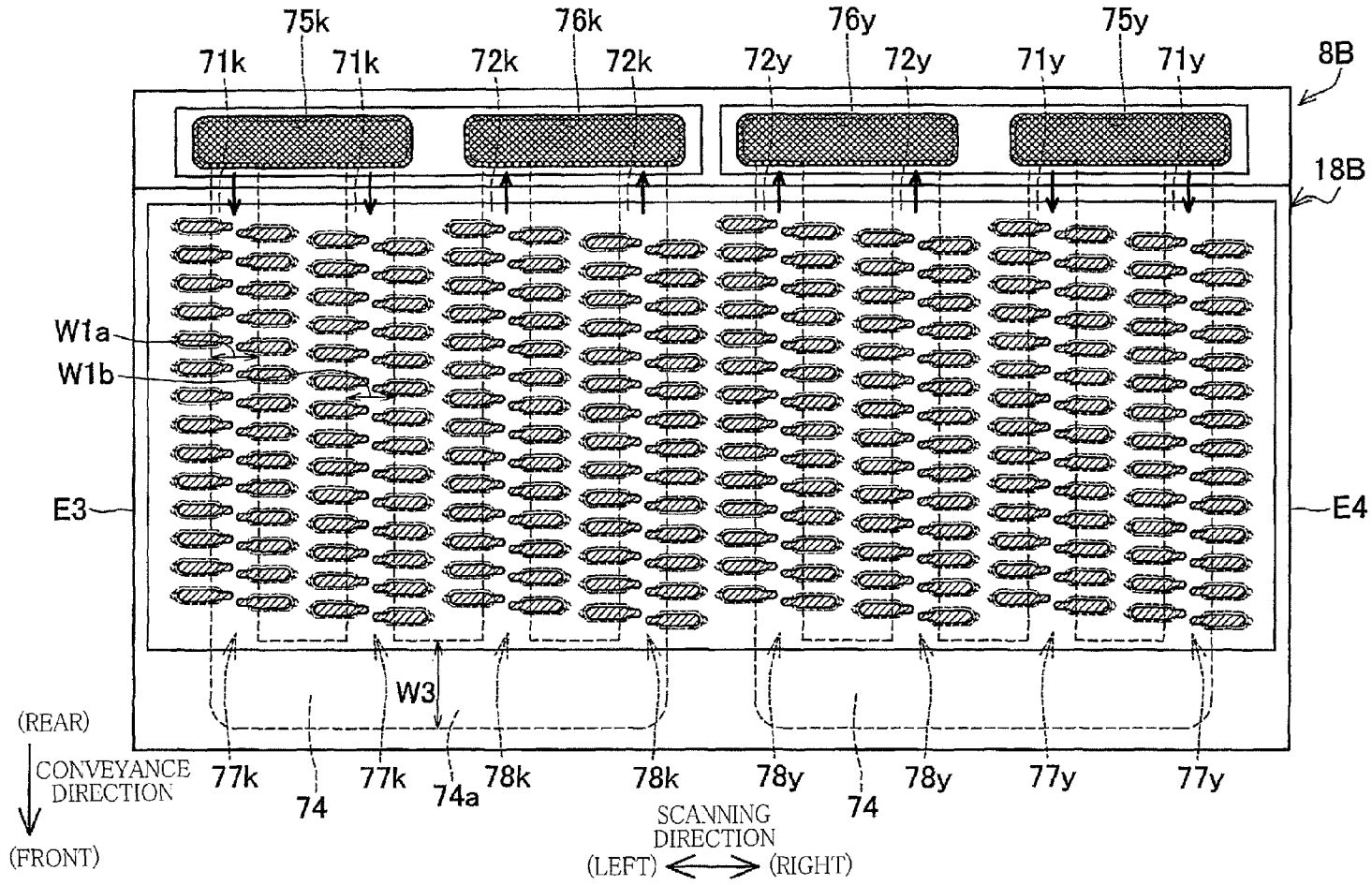
FIG. 8 is a plan view of an ink-jet head (8B) according to one modification.

(1) A flow-path unit 18B of an ink-jet head 8B shown in FIG. 8 includes, for the ink in one color, two first manifolds 71*k* (71*y*) communicating with one ink supply opening 75*k* (75*y*) and two second manifolds 72*k* (72*y*) communicating with one ink discharge opening 76*k* (76*y*). That is, the flow-path unit 18B includes, for the ink in one color, two first nozzle groups 77*k* (77*y*) respectively communicating with the two first manifolds 71*k* (71*y*) and two second nozzle groups 78*k* (78*y*) respectively communicating with the two second manifolds 72*k* (72*y*).

In FIG. 8, the two first manifolds 71*k* for the black ink are disposed near to a left-side edge E3 of the outer periphery of the flow-path unit 18B, and the two first manifolds 71*y* for the yellow ink are disposed near to a right-side edge E4 of the outer periphery of the flow-path unit 18B. In this configuration, the two edges of the outer periphery of the flow-path unit 18B which tend to get cold due to a large heat dissipation amount can be effectively made warm by the ink having a high temperature and flowing through the two first manifolds 71*k* (71*y*).

The two first manifolds 71*k* and the two second manifolds 72*k* are connected by a single connecting path 74, and the two first manifolds 71*y* and the two second manifolds 72*y* are connected by a single connecting path 74. The four manifolds are thus connected by the single connecting path 74, so as to prevent a size increase of the ink-jet head 8B.

In the above configuration, however, it is desirable to take some measures for preventing the resistance to the flow of the ink in the connecting path 74 from becoming excessively large. For instance, a cross sectional area of an intermediate portion 74*a* of the connecting path 74 is preferably larger than a cross sectional area of each first manifold 71*k* (71*y*), the intermediate portion 74*a* being intermediate between: a connected portion at which the connecting path 74 and each first manifold 71*k* (71*y*) are connected; and a connected portion at which the connecting path 74 and each second manifold 72*k* (72*y*) are connected. Here, the cross sectional area means an area of a cross section in a direction orthogonal to a direction of the flow of the ink. Specifically, the cross sectional area of the connecting path 74 is an area of a cross section orthogonal to the scanning direction, and the cross sectional area of each first manifold 71*k* (71*y*) is an area of a cross section orthogonal to the conveyance direction. The cross sectional areas of the connecting path 74 and each first manifold 71*k* (71*y*) may be determined as follows:

the first manifold: width 1.5 mm, height 0.25 mm, cross sectional area 0.375 $mm^2$ the connecting path: width 2 mm, height 0.25 mm, cross sectional area 0.5 $mm^2$ In an instance where the connecting path 74 and each first manifold 71*k* (71*y*) has the same height, a width W3 of the connecting path 74 in the conveyance direction is made larger than widths W1*a*, W1*b* of the respective two first manifolds 71*k* (71*y*) in the scanning direction.

The cross sectional area of the intermediate portion 74*a* of the connecting path 74 is preferably equal to or larger than a sum of the cross sectional areas of the respective two first manifolds 71*k* (71*y*). The cross sectional area of the connecting path 74 and the cross sectional area of each first manifold 71*k* (71*y*) may be determined as follows:

the first manifold: width 1.5 mm, height 0.25 mm, cross sectional area 0.375 $mm^2$ the connecting path: width 3 mm, height 0.25 mm, cross sectional area 0.75 $mm^2$ In an instance where the connecting path 74 and each first manifold 71*k* (71*y*) has the same height, the widths W3, W1*a*, W1*b* are determined to satisfy W3≥W1*a*+W1*b*.

The connecting path 74 and the first manifolds 71 may have mutually different heights as long as the above relationships are satisfied. For instance, the connecting path 74 may be formed through four plates (e.g., the plates 44-47 in FIG. 5) of the flow-path unit 18B in the up-down direction, and the first manifolds 71 may be formed through three plates in the up-down direction, so that the connecting path 74 and the first manifolds 71 have mutually different heights.

Figure 9:
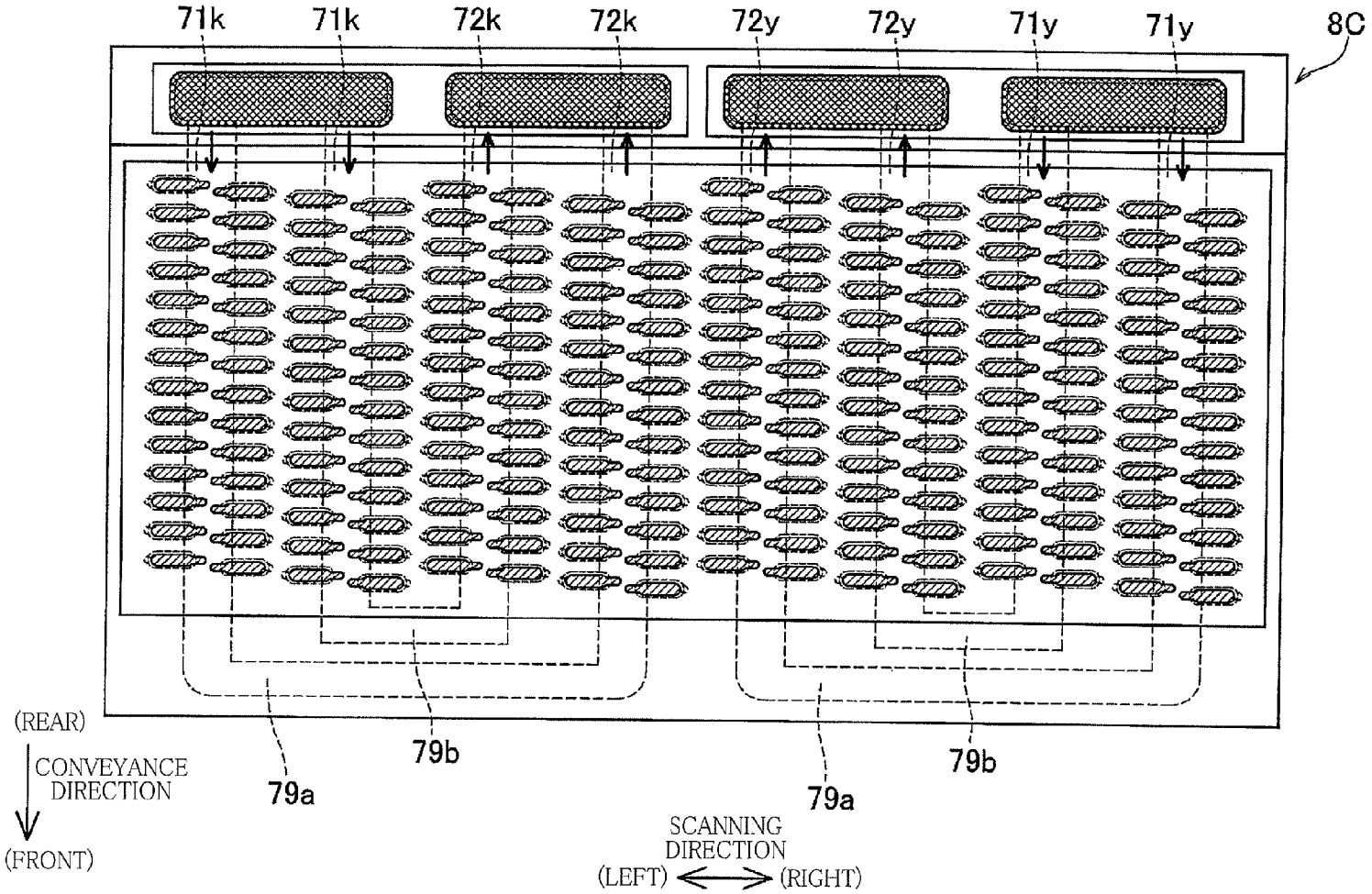
FIG. 9 is a plan view of an ink-jet head (8C) according to one modification.

(2) In FIG. 8, the two first manifolds 71*k* (71*y*) are connected to one common connecting path 74. In an ink-jet head 8C shown in FIG. 9, two connecting paths 79*a*, 79*b* may be provided so as to correspond to the respective two first manifolds 71*k* (71*y*). That is, one connecting path 79*a* (79*b*) provided for one first manifold 71*k* (71*y*) may connect the one first manifold 71*k* (71*y*) and one second manifold 72*k* (72*y*). A specific explanation will be given taking the manifolds for the black ink as one example. Among the four manifolds for the black ink arranged in the scanning direction, outer one of the two first manifolds 71*k* and outer one of the two second manifolds 72*k* are connected by an outer connecting path 79*a* located downstream in the conveyance direction, so as to form an outer flow path. Inner one of the two first manifolds 71*k* and inner one of the two second manifolds 72*k* are connected by an inner connecting path 79*b* located upstream in the conveyance direction, so as to form an inner flow path.

Figure 10:
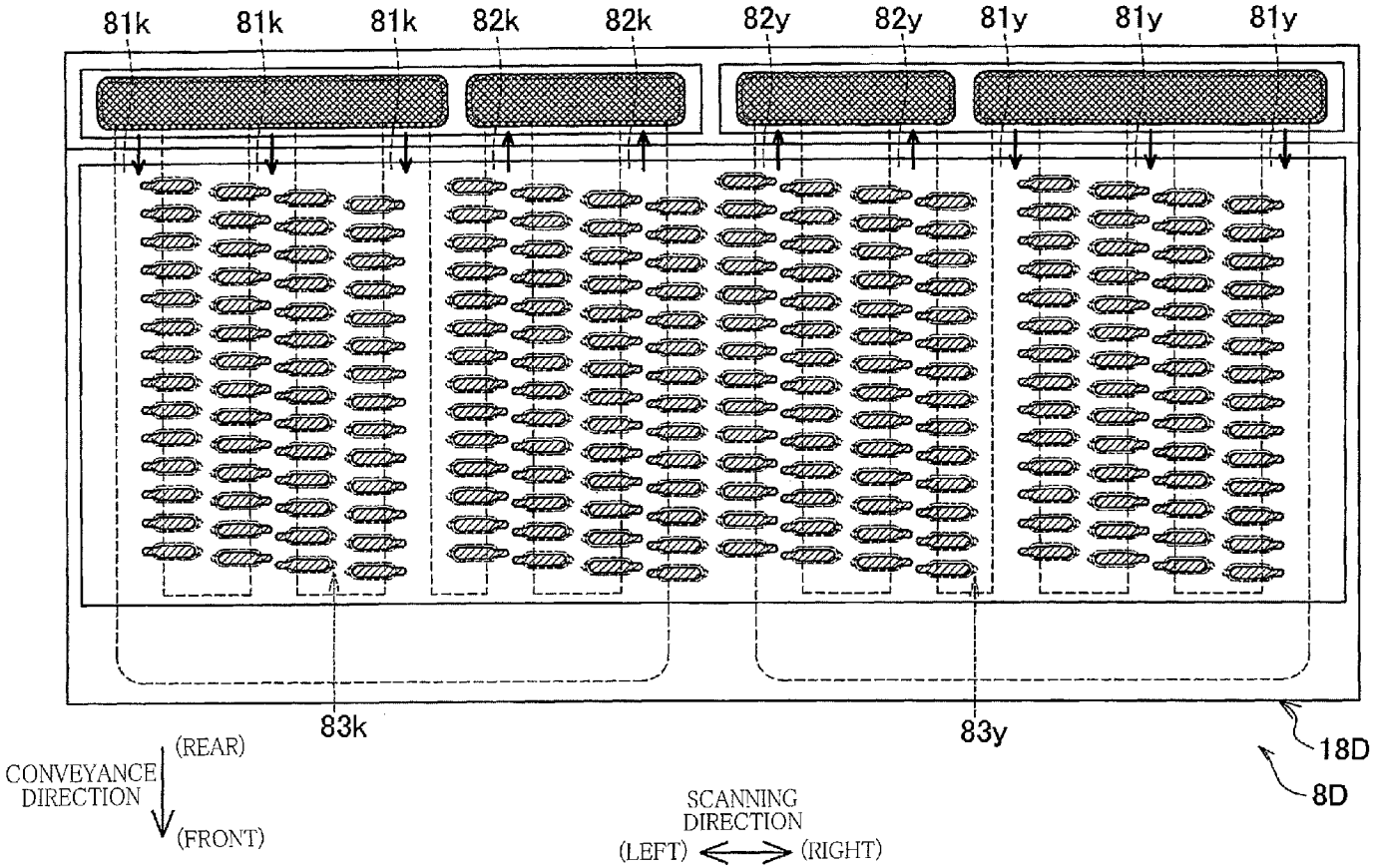
FIG. 10 is a plan view of an ink-jet head (8D) according to one modification.

(3) An ink-jet head 8D shown in FIG. 10 includes, for each color, three first manifolds 81*k* (81*y*) and two second manifolds 82*k* (82*y*). Thus, the number of the first manifolds 81*k* (81*y*) is larger than the number of the second manifolds 82*k* (82*y*). Two nozzle rows 83*k* (83*y*) communicate with a middle one of the three first manifolds 81*k* (81*y*) whereas only one nozzle row 83*k* (81*y*) communicates with each of left-side and right-side first manifolds 81*k* (81*y*). In this configuration, the number of the first manifolds 81*k* (81*y*) disposed near to the outer periphery of the flow-path unit 18D is larger than the number of the second manifolds 82*k* (82*y*), so that the outer periphery which tends to get cold due to a large heat dissipation amount can be effectively made warm by the ink having a high temperature and flowing through the first manifolds 81*k* (81*y*).

(4) In an instance where two sets of manifolds (the first manifold and the second manifold) corresponding to respective two colors are provided in one flow-path unit, the number of the first manifolds may differ between the two sets of manifolds corresponding to the respective two colors. In an ink-jet head 8E shown in FIG. 11, three first manifolds 84*k* for the black ink are disposed near to a left-side edge E5 of the outer periphery of the flow-path unit 18E, and two the second manifolds 85*k* for the black ink are disposed on an inner side of the first manifolds 84*k*. Further, two first manifolds 84*y* for the yellow ink are disposed near to a right-side edge E6 of the outer periphery of the flow-path unit 18E, and two second manifolds 85*y* are disposed on an inner side of the first manifolds 84*y*. In an instance where the temperature conditions differ between the left side and the right side of the flow-path unit 18E due to a difference between a distance from the left-side edge E5 to the leftmost first manifold

Figure 11:
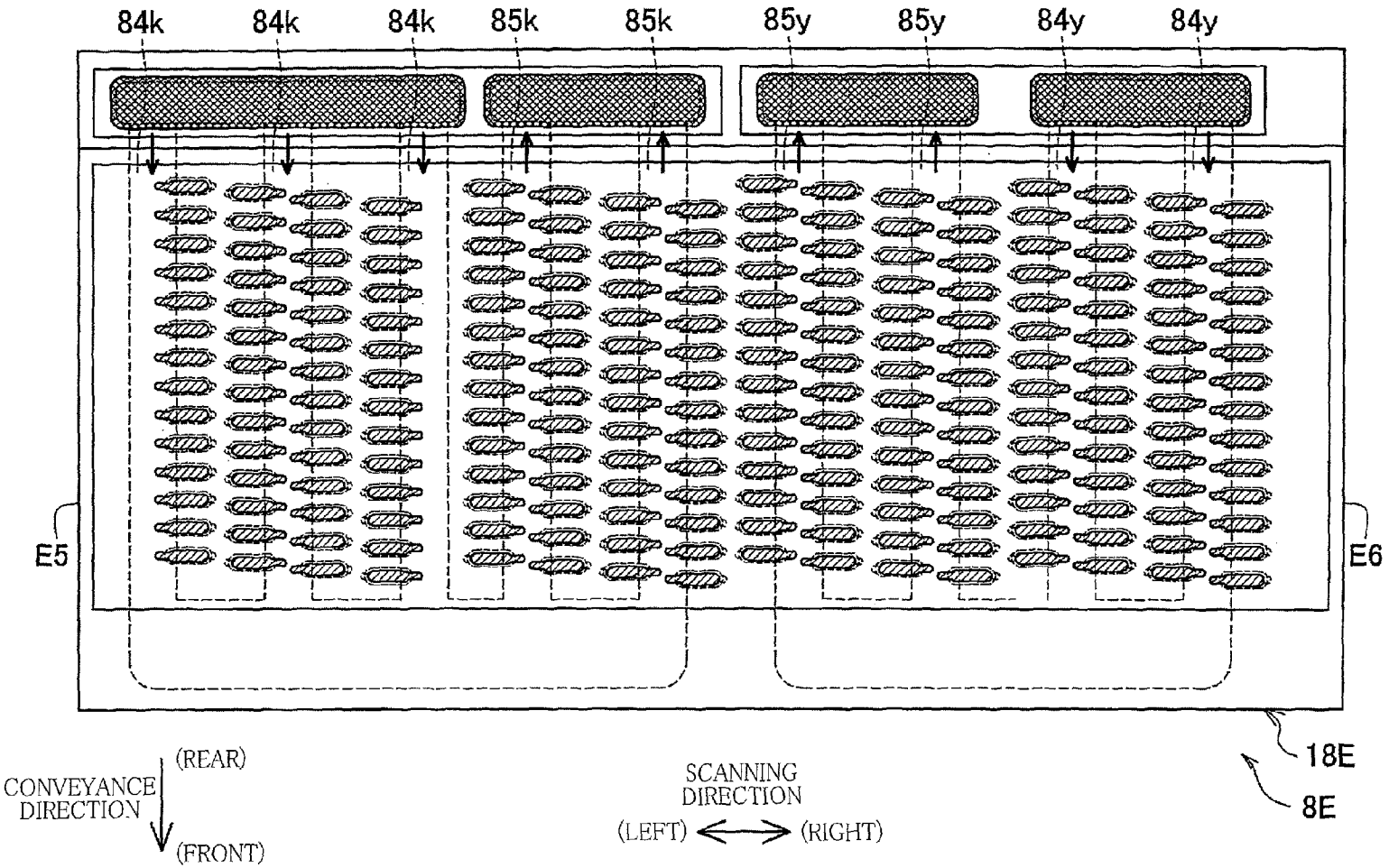
FIG. 11 is a plan view of an ink-jet head (8E) according to one modification.

84*k* and a distance from the right-side edge E6 to the rightmost first manifold 84*y*, it is effective to differ the number of the first manifolds 84 between the two colors, as shown in FIG. 11.

<3> For preventing or reducing a decrease in the temperature at the outer periphery of the flow-path unit 18, there may be employed a structure for promoting heat transmission, to the flow-path unit, from the ink having a high temperature and flowing through the first manifold.

Figure 12:
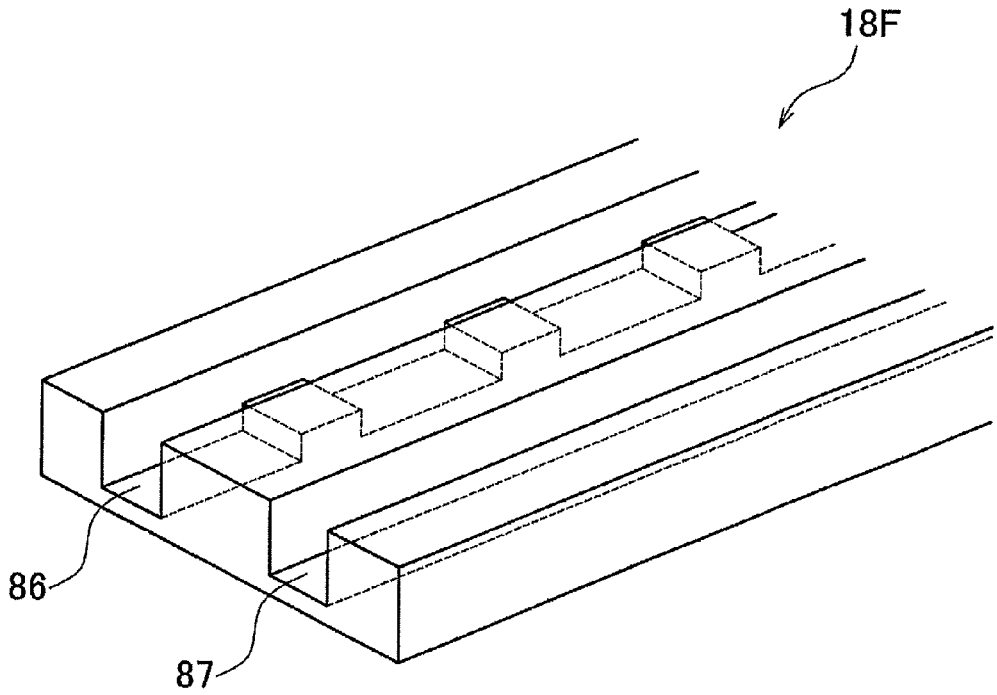
FIG. 12 is a perspective view of a lower portion of a flow-path unit according to one modification.
Figure 13:
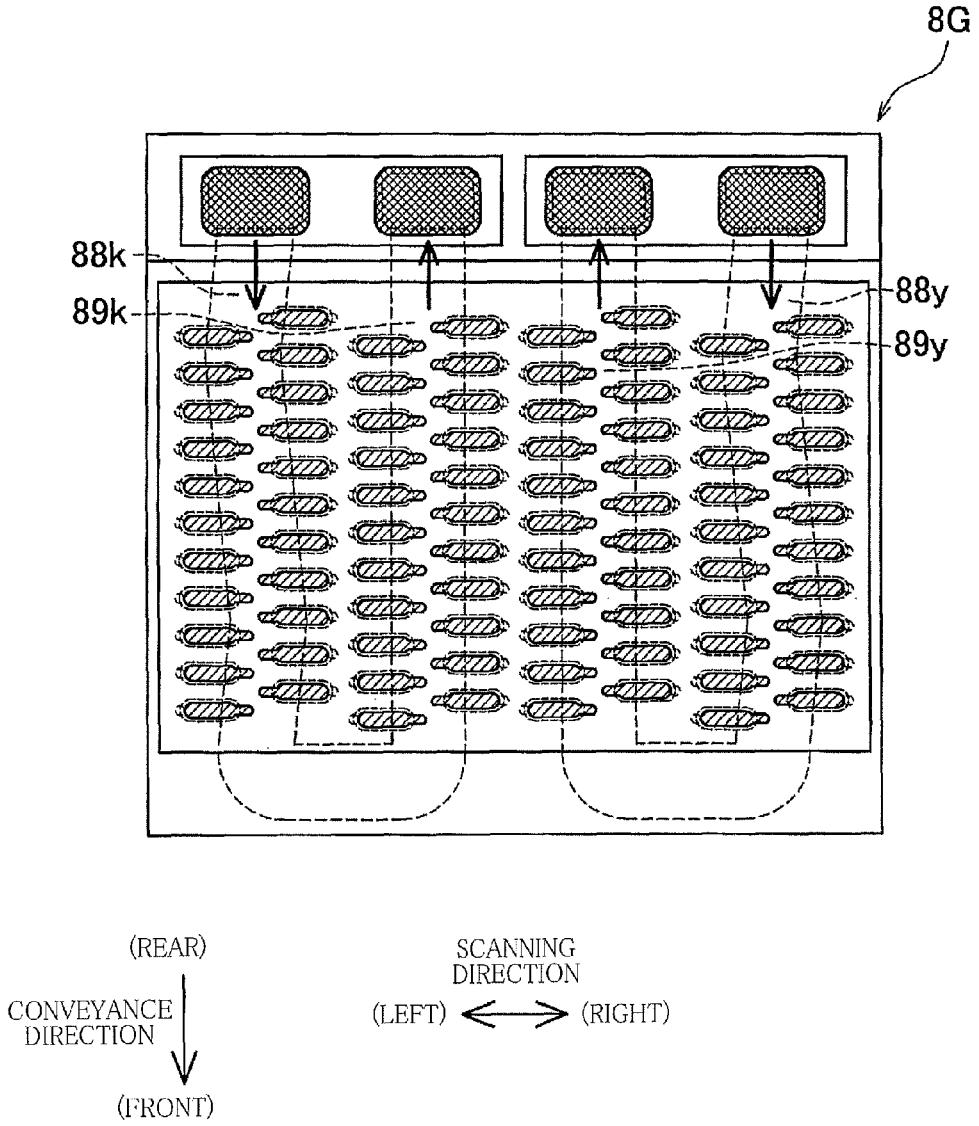
FIG. 13 is a plan view of an ink-jet head (8G) according to one modification.

As shown in FIG. 12, in a flow-path unit 18F including a first manifold 86 and a second manifold 87, the first manifold 86 may have an inner wall surface (a bottom surface in FIG. 12) on which protrusions are formed, so as to increase a contact area of the inner wall surface of the first manifold 86 with the ink. Alternatively, as shown in an ink-jet head 8G of FIG. 13, a first manifold 88 may extend in the conveyance direction while bending or meandering, so that the first manifold 88 may have a length longer than that of the second manifold 89. Thus, the increased length of the first manifold 88 increases the contact area of the inner wall surface of the first manifold 88 with the ink.

Figure 14:
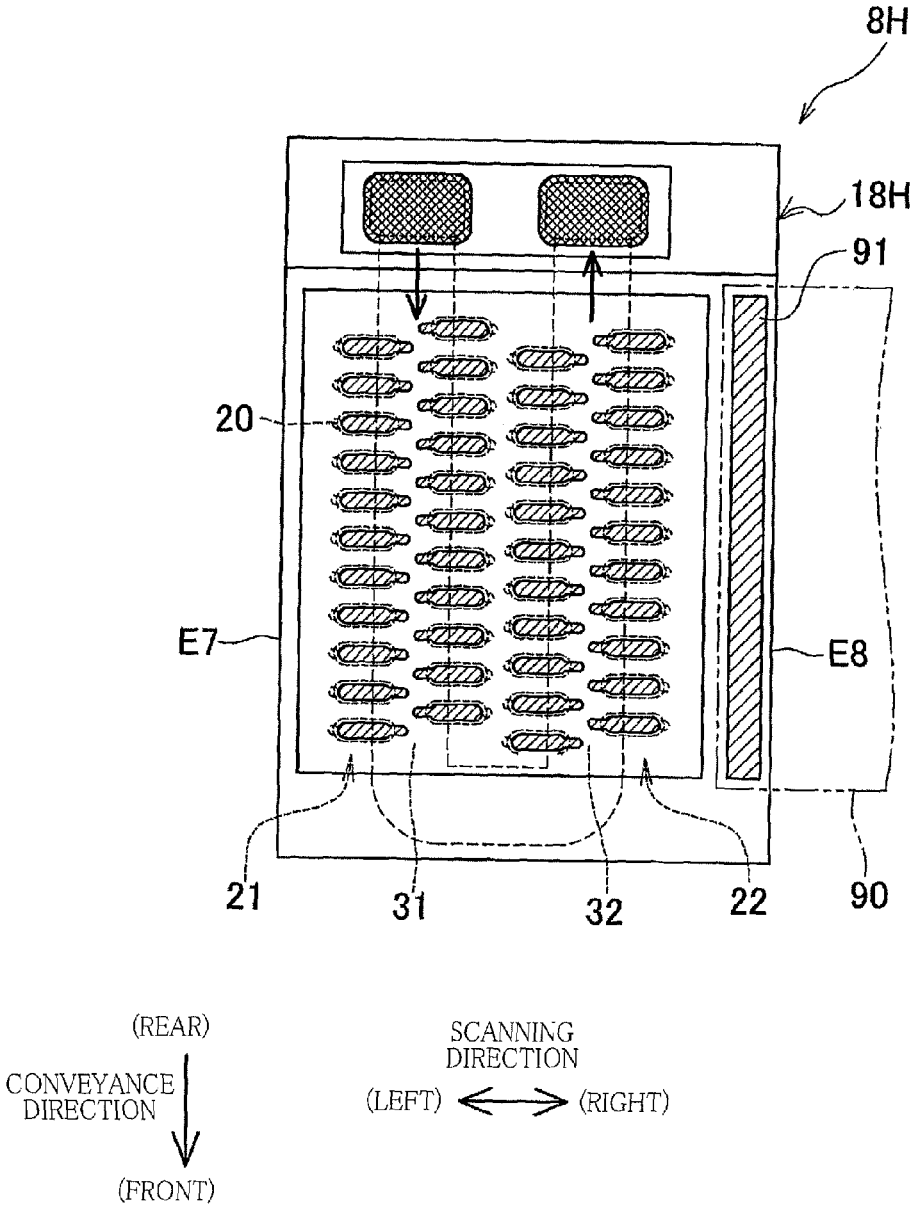
FIG. 14 is a plan view of an ink-jet head (8H) according to one modification.

<4> In the first embodiment shown in FIG. 3, one ink-jet head 8 includes two sets of the nozzle groups and two sets of the manifolds corresponding to the respective two ink colors. As shown in an ink-jet head 8H of FIG. 14, only one set of the nozzle groups 21, 22 and only one set of the manifolds 31, 32 corresponding to one ink color may be provided. In the ink-jet head 8H of FIG. 14, the nozzle-formed region in which the nozzles 20 are formed is disposed so as to be shifted leftward in a flow-path unit 18H. Specifically, in the flow-path unit 18H, a distance from a left-side edge E7 of the outer periphery of the flow-path unit 18H to the left-side nozzle group 21 in the scanning direction is 3 mm, and a distance from a right-side edge E8 of the outer periphery of the flow-path unit 18H to the right-side nozzle group 22 in the scanning direction is 8 mm. In the thus formed flow-path unit 18H, a connection terminal 91 to which a wiring member 90 for driving the piezoelectric actuator 19 is to be connected is provided on the upper surface of the right end portion of flow-path unit 18H, for instance. In this configuration, the left-side edge E7 is nearer to the nozzle-formed region than the right-side edge E8, and it is desirable to prevent or reduce a decrease in the temperature at the left-side edge E7. In view of this, the first manifold 31 is disposed nearer to the left-side edge E7 of the outer periphery of the flow-path unit 18H than the second manifold 32.

Figure 15:
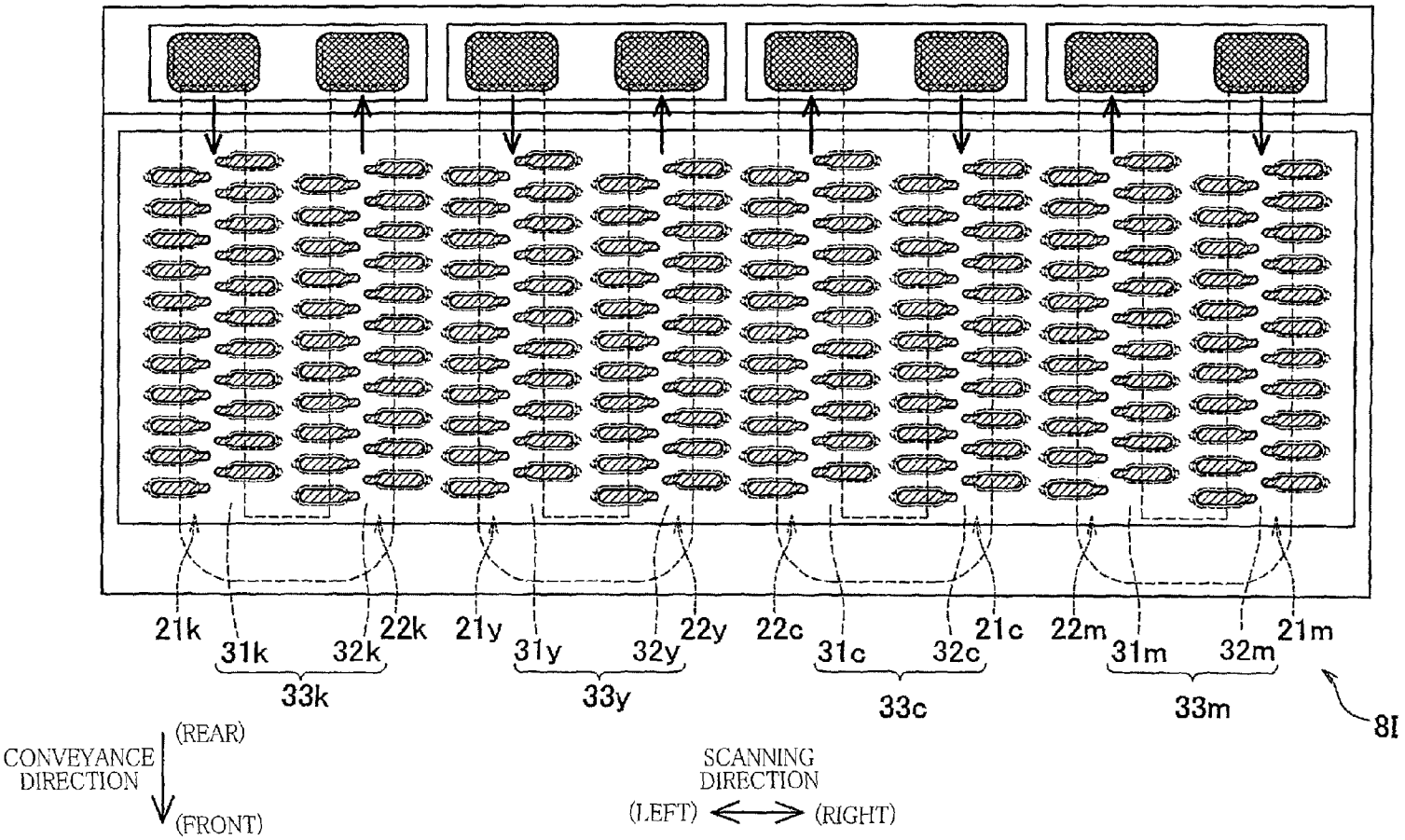
FIG. 15 is a plan view of an ink-jet head (8I) according to one modification.

As shown in FIG. 15, one ink-jet head 81 may include four first nozzle groups 21*k*, 21*y*, 21*c*, 21*m*, the four second nozzle groups 22*k*, 22*y*, 22*c*, 22*m*, four first manifolds 31*k*, 31*y*, 31*c*, 31*m*, and four second manifolds 32*k*, 32*y*, 32*c*, 32*m*, so as to correspond to the respective four colors (black, yellow, cyan, magenta). According to this configuration, in two manifold sets 33*k*, 33*m* located at respective opposite ends of the ink-jet head 81 in the scanning direction, the first manifold 31*k* (31*m*) is located more outside than the second manifold 32*k* (32*m*) in the scanning direction. For the manifold sets 33*y*, 33*c* disposed between the two manifold sets 33*k*, 33*m*, the positions of the first manifold 31*y* (31*c*) and the second manifold 32*y* (32*c*) in the right-left direction may be freely determined.

Second Embodiment

There will be next explained a second embodiment. In the illustrated first embodiment, the principle of the invention is applied to the so-called serial printer in which the ink-jet heads 8 mounted on the carriage 6 eject ink toward the recording sheet 200 while moving in the scanning direction. In the second embodiment, the principle of the invention is applied to a line printer for monochrome printing.

Figure 16:
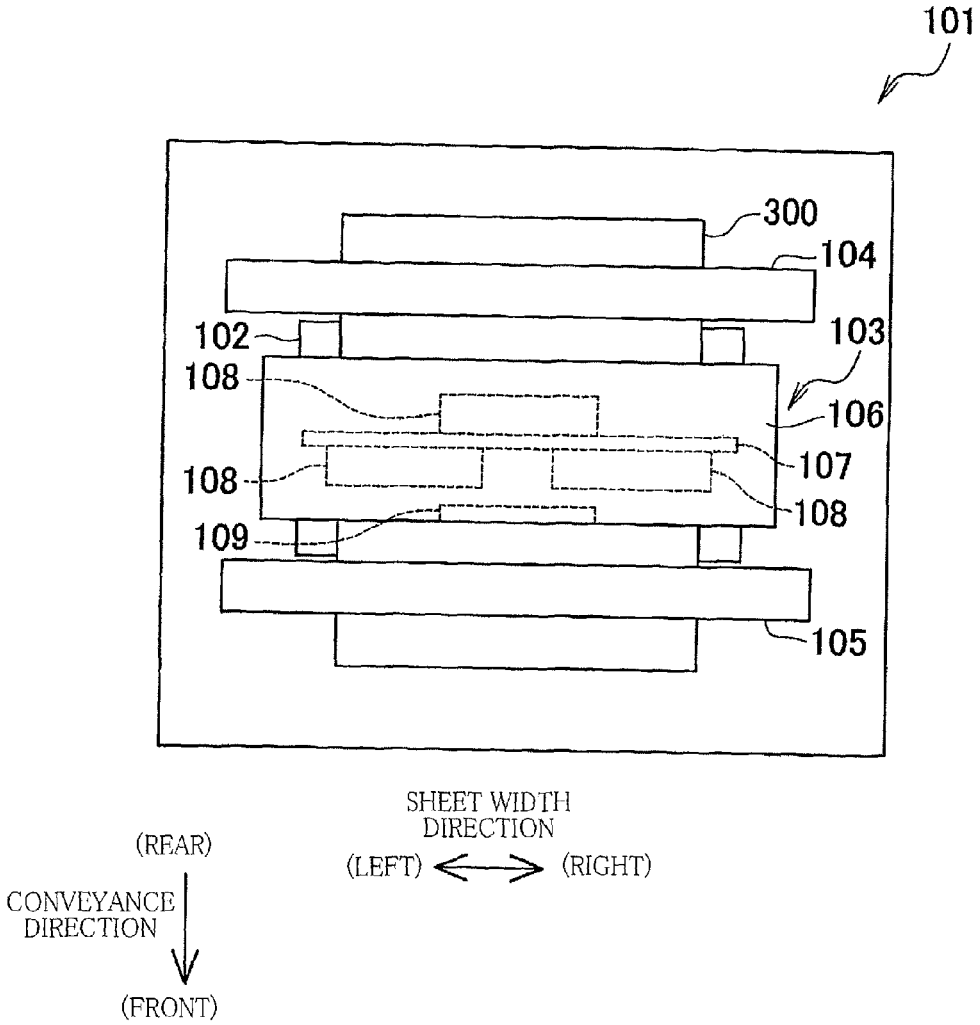
FIG. 16 is a plan view of an ink-jet printer according to a second embodiment.

In FIG. 16, a downstream side of a printer 101 in the conveyance direction is defined as a front side, and an upstream side of the printer 101 in the conveyance direction is defined as a rear side of the printer 101. Further, a width direction of the sheet (sheet width direction) orthogonal to the conveyance direction is defined as a right-left direction of the printer 101. The left side and the right side in FIG. 16 respectively correspond to a left side and a right side of the printer 101. A direction orthogonal to both of the conveyance direction and the sheet width direction, i.e., a direction orthogonal to the sheet plane of FIG. 16, is defined as an up-down direction of the printer 101. One of opposite sides of the sheet of FIG. 16 corresponding to the front surface of the sheet is defined as an upper side of the printer 101 while the other side corresponding to the back surface of the sheet is defined as a lower side of the printer 101. The following description is based on these definitions.

As shown in FIG. 16, the printer 101 of the second embodiment includes a platen 102, an ink ejecting device 103, and two conveying rollers 104, 105. The ink ejecting device 103 is disposed above the platen 102. The ink ejecting device 103 is configured to eject ink toward a recording sheet 300 conveyed in the conveyance direction by the two conveying rollers 104, 105.

Figure 17:
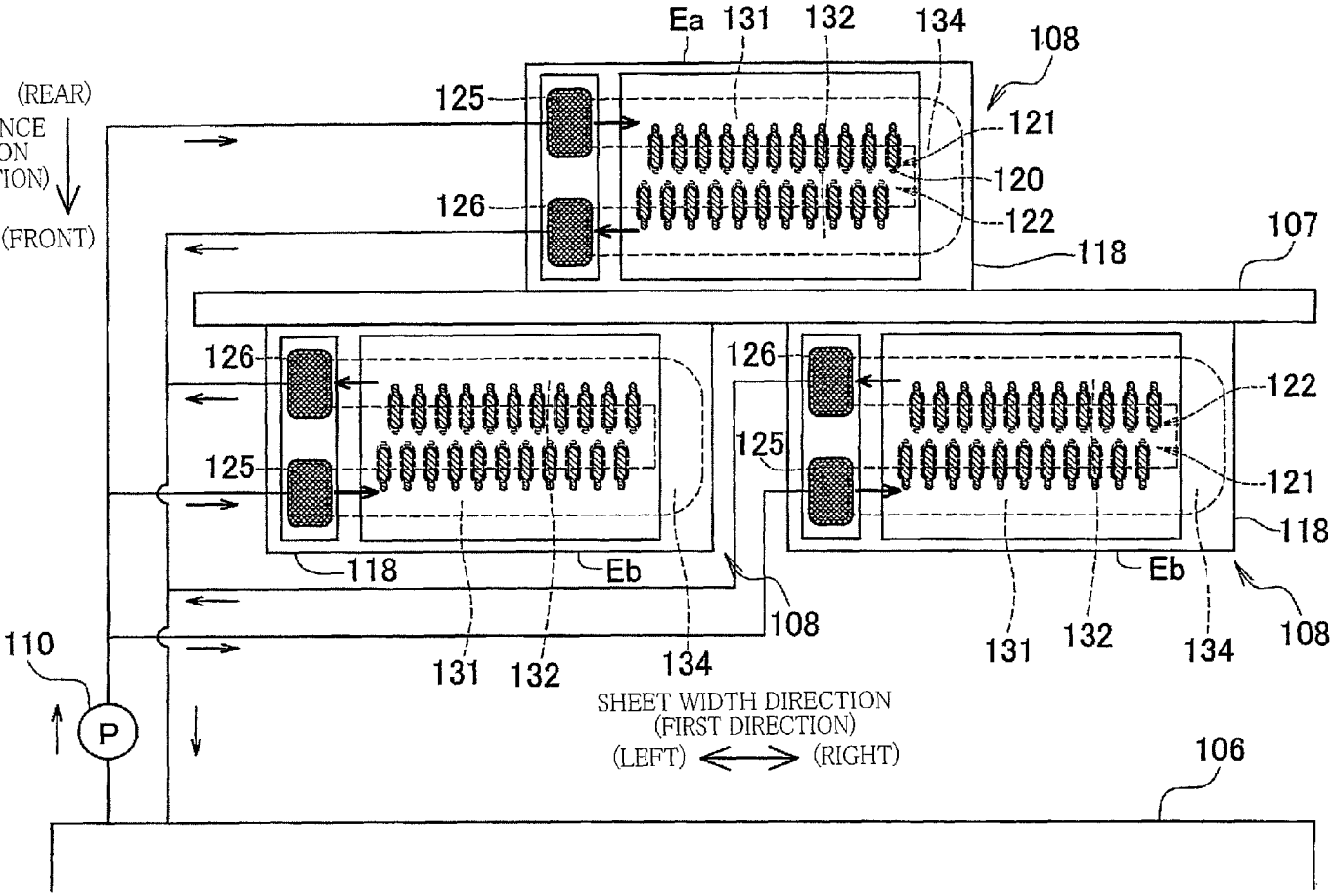
FIG. 17 is a plan view of three ink-jet heads of the printer of FIG. 16.

As shown in FIGS. 16 and 17, the ink ejecting device 103 includes a sub tank 106, three ink-jet heads 108, and a supporter 107. The sub tank 106 is connected to ink cartridges (not shown) and temporarily stores ink supplied from the ink cartridges. The three ink-jet heads 108 are disposed below the sub tank 106 while being supported by the supporter 107. FIG. 17 shows a connection between the sub tank 106 and the three ink-jet heads 108. For easy viewing, the sub tank 106 and the three ink-jet heads 108 do not overlap in FIG. 17. Actually, the sub tank 106 and the three ink-jet heads 108 are disposed so as to overlap in the up-down direction, as shown in FIG. 16. As shown in FIG. 17, ink supply openings 125 of the respective three ink-jet heads 108 are connected to the sub tank 106 by respective tubes, and ink discharge openings 126 of the respective three ink-jet heads 108 are connected to the sub tank 106 by respective tubes.

As shown in FIG. 16, the sub tank 106 is provided with a heater 109 for heating the ink stored in the sub tank 106. As shown in FIG. 17, a circulating pump 110 is disposed between the sub tank 106 and the ink supply openings 125 of the three ink-jet heads 108. The ink heated in the sub tank 106 by the heater 109 is fed by the circulating pump 110 to the ink supply openings 125 of the three ink-jet heads 108. The ink discharged from the ink discharge openings 126 of the three ink-jet heads 108 is returned to the sub tank 106.

The three ink-jet heads 108 are disposed alternately on an upstream side and a downstream side with respect to the supporter 107 in the conveyance direction. That is, one of the three ink-jet heads 108 is disposed on the upstream side in the conveyance direction with respect to the supporter 107 extending in the sheet width direction, and the other two ink-jet heads 108 are disposed on the downstream side in the conveyance direction with respect to the supporter 107. Thus, the positions of the respective three ink-jet heads 108 are shifted relative to each other in the right-left direction, i.e., in the sheet width direction.

A flow-path unit 118 of each ink-jet head 108 includes a first nozzle group 121 constituted by nozzles 120 arranged in the sheet width direction, a second nozzle group 122 constituted by nozzles 120 arranged in the sheet width direction, a first manifold 131 communicating with the first nozzle group 121, and a second manifold 132 communicating with the second nozzle group 122. The first manifold 131 and the second manifold 132 extend in the sheet width direction. The first manifold 131 communicates, at its left end, with the ink supply opening 125, and the second manifold 132 communicates, at its left end, with the ink discharge opening 126. The first manifold 131 and the second manifold 132 are connected to each other at respective right ends thereof by a connecting path 134. That is, there is formed, in the flow-path unit 118 of each ink-jet head 108, a U-shaped flow path starting from the ink supply opening 125, passing from the first manifold 131 to the second manifold 132 via the connecting path 134, and reaching the ink discharge opening 126.

When focusing on any one of the three ink-jet heads 108, the heat dissipation amount is large and the temperature tends to be accordingly lowered at an outer peripheral edge of the flow-path unit 118 of the one ink-jet head 108 in the conveyance direction that is remote from another one of the ink-jet heads 108 disposed alongside in the conveyance direction, namely, at an outer peripheral edge of the flow-path unit 118 in the conveyance direction that is remote from the supporter 107. In other words, the temperature tends to be lowered at one of opposite portions, in the conveyance direction, of the outer periphery of the flow-path unit 118 of the one ink-jet head 108, the one of the opposite portions being remote from another one of the ink-jet heads 108 disposed alongside in the conveyance direction. This goes for all of the three ink-jet heads 108. In view of this, the first manifold 131 in each of all of the three ink-jet head 108 is disposed nearer to the above-indicated outer peripheral edge than the second manifold 132. Specifically, in one of the ink-jet heads 108 located on the upstream side in the conveyance direction, the first manifold 131 is disposed nearer to an upstream-side outer peripheral edge Ea than the second manifold 132. In each of two of the ink-jet heads 108 located on the downstream side in the conveyance direction, the first manifold 131 is disposed nearer to a downstream-side outer peripheral edge Eb than the second manifold 132.

In the second embodiment described above, the ink ejecting device 103 is one example of "liquid ejecting device". The ink-jet head 108 is one example of "liquid ejecting head". The sub tank 106 is one example of "reservoir". The circulating pump 110 is one example of "liquid circulator". The conveyance direction is one example of "second direction" while the sheet width direction is one example of "first direction". The ink supply opening 125 is one example of "liquid supply opening" while the ink discharge opening 126 is one example of "liquid discharge opening". The first manifold 131 is one example of "first common liquid chamber" while the second manifold 132 is one example of "second common liquid chamber".

Third Embodiment

Figure 18:
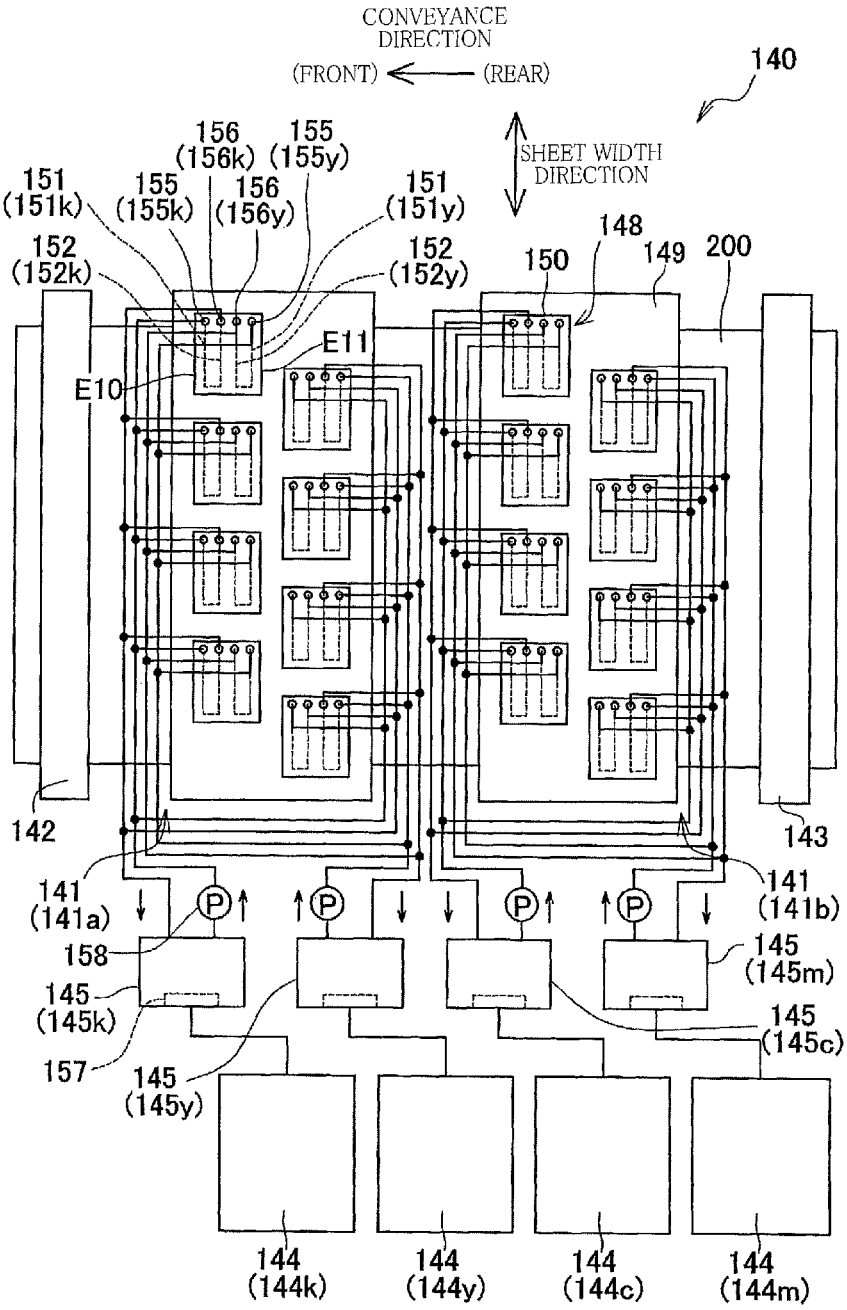
FIG. 18 is a plan view of an ink-jet printer according to a third embodiment.

There will be next explained a third embodiment. In the third embodiment, the principle of the invention is applied to an industrial ink-jet printer for printing color images on large-size posters and the like. As shown in FIG. 18, an ink-jet printer 140 of the third embodiment includes two ink ejecting devices 141 (141*a*, 141*b*), two conveying rollers 142, 143, four ink tanks 144 (144*k*, 144*y*, 144*c*, 144*m*), and four sub tanks 145 (145*k*, 145*y*, 145*c*, 145*m*).

The two ink ejecting devices 141 are disposed alongside each other in the conveyance direction. The two conveying rollers 142, 143 configured to convey the recording sheet 200 in the conveyance direction with respect to the two ink ejecting devices 141. The four ink tanks 144 (144*k*, 144*y*, 144*c*, 144*m*) respectively store black ink, yellow ink, cyan ink, and magenta ink. The four sub tanks 145 (145*k*, 145*y*, 145*c*, 145*m*) are connected to the respective four ink tanks 144. Each sub tank 145 temporality stores the ink supplied from the corresponding ink tank 144.

The two sub tanks 145*k*, 145*y* are connected to the ink ejecting device 141*a* disposed on the downstream side in the conveyance direction (i.e., the front side). The ink ejecting device 141*a* is configured to eject the black ink and the yellow ink supplied from the respective two sub tanks 145*k*, 145*y*. The two sub tanks 145*c*, 145*m* are connected to the ink ejecting device 141*b* disposed on the upstream side in the conveyance direction (i.e., the rear side). The ink ejecting device 141*b* is configured to eject the cyan ink and the magenta ink supplied from the respective two sub tanks 145*c*, 145*m*.

Because the two ink ejecting devices 141*a*, 141*b* are identical to each other in construction, only the front-side ink ejecting device 141*a* will be explained. The ink ejecting device 141*a* includes eight ink-jet heads 148 and a head holder 149 holding the eight ink-jet heads 148. The eight ink-jet heads 148 are arranged in a zigzag fashion in the sheet width direction orthogonal to the conveyance direction.

Each ink-jet head 148 is similar in construction to the ink-jet head 8 of the first embodiment. A flow-path unit 150 of each ink-jet head 148 includes, for each of the black ink and the yellow ink, an ink supply opening 155 (155*k*, 155*y*), an ink discharge opening 156 (156*k*, 156*y*), a first manifold 151 (151*k*, 151*y*), and a second manifold 152 (152*k*, 152*y*). A nozzle group (not shown) communicates with each of the first manifold 151 and the second manifold 152. The ink supply opening 155 is disposed nearer to an outer periphery of the flow-path unit 150 in the conveyance direction, namely, an outer peripheral edge E10 (E11) of the flow-path unit 150 in the conveyance direction, than the ink discharge opening 156. Thus, the first manifold 151 communicating with the ink supply opening 155 is also disposed nearer to the outer peripheral edge E10 (E11) than the second manifold 152 communicating with the ink discharge opening 156.

The ink supply opening 155 and the ink discharge opening 156 of each ink-jet head 148 is connected to one sub tank 145, and the ink is circulated between the ink-jet head 148 and the sub tank 145. That is, the ink heated by a heater 157 in the sub tank 145 is pressurized by a circulating pump 158 and is supplied to the ink supply opening 15. The ink discharged from the ink discharge opening 156 is returned to the sub tank 145.

Thus, in each of the ink-jet heads 148, the first manifold 151 communicating with the ink supply opening 155 is disposed near to the outer periphery of the flow-path unit 150 in the conveyance direction, namely, an outer peripheral edge E11) (E11) of the flow-path unit 150 in the conveyance direction. Consequently, the temperature decrease is prevented or reduced at the outer peripheral edge E10 (E11) of the flow-path unit 150.

In the illustrated embodiments, the principle of the invention is applied to the ink-jet printers configured to print images on the recording sheet by ejecting the ink. The invention is applicable to other liquid ejecting devices in a variety of uses other than printing of images. For instance, the invention is applicable to an industrial liquid ejecting device configured to eject an electrically conductive liquid to a substrate so as to form a conductive pattern on the surface of the substrate.

What is claimed is:

1. A liquid ejecting head, comprising a flow-path unit that includes:

a first nozzle group including a plurality of nozzles arranged in a first direction;

a second nozzle group including a plurality of nozzles arranged in the first direction, the second nozzle group being disposed alongside the first nozzle group in a second direction orthogonal to the first direction;

a first common liquid chamber extending in the first direction and communicating with the first nozzle group;

a second common liquid chamber extending in the first direction and communicating with the second nozzle group, the second common liquid chamber being disposed alongside the first common liquid chamber in the second direction;

a liquid supply opening communicating with one end of the first common liquid chamber in the first direction that is located on one of opposite sides of the flow-path unit in the first direction;

a liquid discharge opening communicating with one end of the second common liquid chamber in the first direction that is located on the one of the opposite sides of the flow-path unit in the first direction; and a connecting path connecting another end of the first common liquid chamber in the first direction that is located on the other of the opposite sides of the flow-path unit in the first direction and another end of the second common liquid chamber in the first direction that is located on the other of the opposite sides of the flow-path unit in the first direction, wherein a cross sectional area of an intermediate portion of the connecting path is larger than a cross sectional are of the first common liquid chamber, the intermediate portion being intermediate between: a connected portion at which the connecting path and the first common liquid chamber are connected; and a connected portion at which the connecting path and the second common liquid chamber is connected, wherein the flow-path unit includes a plurality of first common liquid chambers, each as the first common liquid chamber, and wherein the plurality of first common liquid chambers and the second common liquid chamber are connected to each other by one connecting path, as the connecting path, extending in the second direction.

2. The liquid ejecting head according to claim 1, wherein the cross sectional area of the intermediate portion of the one connecting path is larger than the cross sectional area of each of the plurality of first common liquid chambers.

3. The liquid ejecting head according to claim 2, wherein the cross sectional area of the intermediate portion of the one connecting path is equal to or larger than a sum of the cross sectional areas of the respective first common liquid chambers.

4. The liquid ejecting head according to claim 3, wherein a width of the one connecting path in the first direction is equal to or larger than a sum of widths of the respective first common liquid chambers in the second direction.

5. A liquid ejecting device, comprising:

the liquid ejecting head defined in claim 1;

a reservoir connected to the liquid supply opening and the liquid discharge opening of the liquid ejecting head and storing a liquid;

a liquid circulator configured to circulate the liquid between the reservoir and the liquid ejecting head, and a heater configured to heat the liquid to be supplied to the liquid ejecting head.

6. The liquid ejecting device according to claim 5, comprising:

first and second liquid ejecting heads, each as the liquid ejecting head, which are arranged in the second direction; and a supporter that supports the first and second liquid ejecting heads.

7. The liquid ejecting device according to claim 6, wherein the first and second liquid ejecting heads are disposed so as to be shifted relative to each other in the first direction.

8. A liquid ejecting head, comprising a flow-path unit that includes:

a first nozzle group including a plurality of nozzles arranged in a first direction;

a second nozzle group including a plurality of nozzles arranged in the first direction, the second nozzle group being disposed alongside the first nozzle group in a second direction orthogonal to the first direction;

a first common liquid chamber extending in the first direction and communicating with the first nozzle group;

a second common liquid chamber extending in the first direction and communicating with the second nozzle group, the second common liquid chamber being disposed alongside the first common liquid chamber in the second direction;

a liquid supply opening communicating with one end of the first common liquid chamber in the first direction that is located on one of opposite sides of the flow-path unit in the first direction;

a liquid discharge opening communicating with one end of the second common liquid chamber in the first direction that is located on the one of the opposite sides of the flow-path unit in the first direction; and a connecting path connecting another end of the first common liquid chamber in the first direction that is located on the other of the opposite sides of the flow-path unit in the first direction and another end of the second common liquid chamber in the first direction that is located on the other of the opposite sides of the flow-path unit in the first direction, wherein a cross sectional area of an intermediate portion of the connecting path is larger than a cross sectional area of the first common liquid chamber, the intermediate portion being intermediate between: a connected portion at which the connecting path and the first common liquid chamber are connected; and a connected portion at which the connecting path and the second common liquid chamber is connected, wherein the liquid ejecting head further comprises: a first filter in which a plurality of first pores are formed and which covers the liquid supply opening; and a second filter in which a plurality of second pores are formed and which covers the liquid discharge opening.

9. The liquid ejecting head according to claim 8, further comprising a filter member having the first filter and the second filter and bonded to the flow-path unit so as to commonly cover the liquid supply opening and the liquid discharge opening.

10. The liquid ejecting head according to claim 8, wherein an opening area of the liquid supply opening is larger than an opening area of the liquid discharge opening, and wherein an area of a region of the first filter covering the liquid supply opening is larger than an area of a region of the second filter covering the liquid discharge opening.

11. A liquid ejecting head, comprising a flow-path unit that includes:

a first nozzle group including a plurality of nozzles arranged in a first direction;

a second nozzle group including a plurality of nozzles arranged in the first direction, the second nozzle group being disposed alongside the first nozzle group in a second direction orthogonal to the first direction;

a first common liquid chamber extending in the first direction and communicating with the first nozzle group;

a second common liquid chamber extending in the first direction and communicating with the second nozzle group, the second common liquid chamber being disposed alongside the first common liquid chamber in the second direction;

a liquid supply opening communicating with one end of the first common liquid chamber in the first direction that is located on one of opposite sides of the flow-path unit in the first direction;

a liquid discharge opening communicating with one end of the second common liquid chamber in the first direction that is located on the one of the opposite sides of the flow-path unit in the first direction; and a connecting path connecting another end of the first common liquid chamber in the first direction that is located on the other of the opposite sides of the flow-path unit in the first direction and another end of the second common liquid chamber in the first direction that is located on the other of the opposite sides of the flow-path unit in the first direction, wherein a cross sectional area of an intermediate portion of the connecting path is larger than a cross sectional area of the first common liquid chamber, the intermediate portion being intermediate between: a connected portion at which the connecting path and the first common liquid chamber are connected; and a connected portion at which the connecting path and the second common liquid chamber is connected, wherein the flow-path unit includes:

a plurality of sets of nozzle groups each of which includes the first nozzle group and the second nozzle group; and a plurality of sets of common liquid chambers which respectively correspond to the plurality of sets of nozzle groups and each of which includes the first common liquid chamber and the second common liquid chamber, and wherein the plurality of sets of common liquid chambers are arranged in the second direction.

12. The liquid ejecting head according to claim 11, wherein the number of the first common liquid chambers differs among the plurality of sets of common liquid chambers.

13. A liquid ejecting head, comprising a flow-path unit that includes:

a first nozzle group including a plurality of nozzles arranged in a first direction;

a second nozzle group including a plurality of nozzles arranged in the first direction, the second nozzle group being disposed alongside the first nozzle group in a second direction orthogonal to the first direction;

a first common liquid chamber extending in the first direction and communicating with the first nozzle group;

a second common liquid chamber extending in the first direction and communicating with the second nozzle group, the second common liquid chamber being disposed alongside the first common liquid chamber in the second direction;

a liquid supply opening communicating with one end of the first common liquid chamber in the first direction that is located on one of opposite sides of the flow-path unit in the first direction;

a liquid discharge opening communicating with one end of the second common liquid chamber in the first direction that is located on the one of the opposite sides of the flow-path unit in the first direction; and a connecting path connecting another end of the first common liquid chamber in the first direction that is located on the other of the opposite sides of the flow-path unit in the first direction and another end of the second common liquid chamber in the first direction that is located on the other of the opposite sides of the flow-path unit in the first direction, wherein a cross sectional area of an intermediate portion of the connecting path is larger than a cross sectional area of the first common liquid chamber, the intermediate portion being intermediate between: a connected portion at which the connecting path and the first common liquid chamber are connected; and a connected portion at which the connecting path and the second common liquid chamber is connected, wherein the flow-path unit includes a plurality of first common liquid chambers, each as the first common liquid chamber, which are arranged in the second direction and which communicate with one liquid supply opening as the liquid supply opening, wherein the flow-path unit includes at least one second common liquid chamber each as the second common liquid chamber, and wherein the number of the first common liquid chambers is larger than the number of the at least one second common liquid chamber.

14. A liquid ejecting head, comprising a flow-path unit that includes:

a first nozzle group including a plurality of nozzles arranged in a first direction;

a second nozzle group including a plurality of nozzles arranged in the first direction, the second nozzle group being disposed alongside the first nozzle group in a second direction orthogonal to the first direction;

a first common liquid chamber extending in the first direction and communicating with the first nozzle group;

a second common liquid chamber extending in the first direction and communicating with the second nozzle group, the second common liquid chamber being disposed alongside the first common liquid chamber in the second direction;

a liquid supply opening communicating with one end of the first common liquid chamber in the first direction that is located on one of opposite sides of the flow-path unit in the first direction; and a liquid discharge opening communicating with one end of the second common liquid chamber in the first direction that is located on the one of the opposite sides of the flow-path unit in the first direction; and a connecting path connecting another end of the first common liquid chamber in the first direction that is located on the other of the opposite sides of the flow-path unit in the first direction and another end of the second common liquid chamber in the first direction that is located on the other of the opposite sides of the flow-path unit in the first direction, wherein a cross sectional area of an intermediate portion of the connecting path is larger than a cross sectional area of the first common liquid chamber, the intermediate portion being intermediate between: a connected portion at which the connecting path and the first common liquid chamber are connected; and a connected portion at which the connecting path and the second common liquid chamber is connected.

15. A liquid ejecting device, comprising:

the liquid ejecting head defined in claim 14;

a reservoir connected to the liquid supply opening and the liquid discharge opening of the liquid ejecting head and storing a liquid;

a liquid circulator configured to circulate the liquid between the reservoir and the liquid ejecting head, and a heater configured to heat the liquid to be supplied to the liquid ejecting head.

* * * * *